US006597885B2

(12) United States Patent
Kai et al.

(10) Patent No.: US 6,597,885 B2
(45) Date of Patent: Jul. 22, 2003

(54) IMAGE FORMING APPARATUS HAVING A DEVELOPING DEVICE WITH A MAGNET BRUSH

(75) Inventors: Tsukuru Kai, Kanagawa (JP); Nobutaka Takeuchi, Kanagawa (JP); Hisashi Shoji, Kanagawa (JP); Kei Yasutomi, Kanagawa (JP); Takeyoshi Sekine, Tokyo (JP); Osamu Ariizumi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/873,246

(22) Filed: Jun. 5, 2001

(65) Prior Publication Data

US 2002/0037187 A1 Mar. 28, 2002

(30) Foreign Application Priority Data

Jun. 5, 2000 (JP) ..... 2000-167764
Jul. 3, 2000 (JP) ..... 2000-200979
Jul. 6, 2000 (JP) ..... 2000-205493

(51) Int. Cl.[7] ..... G03G 15/09; G03G 21/00
(52) U.S. Cl. ..... 399/277; 399/346
(58) Field of Search ..... 399/267, 277, 399/346

(56) References Cited

U.S. PATENT DOCUMENTS

| | | | |
|---|---|---|---|
| 6,295,437 | B1 | 9/2001 | Hodoshima et al. |
| 6,335,137 | B1 | 1/2002 | Suzuki et al. |
| 6,337,957 | B1 | 1/2002 | Tamaki et al. |
| 6,366,751 | B1 | 4/2002 | Shakuto et al. |
| 6,385,423 | B1 | 5/2002 | Kai |
| 6,403,275 | B1 | 6/2002 | Kuramoto et al. |
| 6,449,452 | B1 | 9/2002 | Kai |
| 6,468,706 | B2 | 10/2002 | Matsuda et al. |
| 6,507,718 | B2 | 1/2003 | Ohjimi et al. |

FOREIGN PATENT DOCUMENTS

| | | | |
|---|---|---|---|
| EP | 1030229 A2 | * | 8/2000 |
| JP | 5-257387 | | 10/1993 |
| JP | 8-101574 | | 4/1996 |
| JP | 8-202226 | | 8/1996 |
| JP | 9-34261 | | 2/1997 |
| JP | 9-127793 | | 5/1997 |
| JP | 2000-10419 | | 1/2000 |
| JP | 2000-19858 | | 1/2000 |
| JP | 2000-47523 | | 2/2000 |
| JP | 2000-47524 | | 2/2000 |
| JP | 2000-131973 A | * | 5/2000 |
| JP | 2000-221838 A | * | 8/2000 |
| JP | 2000-305360 | | 11/2000 |
| JP | 2001-51549 A | * | 2/2001 |
| JP | 2001-51561 A | * | 2/2001 |

* cited by examiner

*Primary Examiner*—Joan Pendegrass
(74) *Attorney, Agent, or Firm*—Oblon, Spivak, McClelland, Maier & Neustadt, P.C.

(57) ABSTRACT

An image forming apparatus including a developing device and an image carrier facing the developing device. The developing device includes a main magnetic pole for causing a developer to magnetically deposit on an outer periphery of a developer carrier in a form of a magnet brush. The image carrier has a coefficient of friction of 0.5 or below, and a flux density in a normal direction has an attenuation ratio of 40% or above.

68 Claims, 32 Drawing Sheets

IMAGE FORMING APPARATUS HAVING A DEVELOPING DEVICE WITH A MAGNET BRUSH

BACKGROUND OF THE INVENTION

The present invention relates to an image forming apparatus of the type causing a developer deposited on a developer carrier to rise in the form of a magnet brush in a developing region and develop a latent image formed on an image carrier.

It is a common practice with a copier, printer, facsimile apparatus or similar electrophotographic or electrostatic image forming apparatus to electrostatically form a latent image on an image carrier in accordance with image data. The image carrier may be implemented by a photoconductive element or a photoconductive belt. A developing device develops the latent image with toner and thereby produces a corresponding toner image. A current trend in the imaging art is toward a magnet brush type developing system using a toner and carrier mixture or two-ingredient type developer. This type of developing system is desirable from the standpoint of image transfer, halftone reproducibility, and stability of development against varying temperature and humidity. Specifically, a developing device using this type of system causes the developer to rise in the form of a brush chain on a developer carrier, so that toner contained in the developer is transferred to a latent image formed on the image carrier at a developing region. The developing region refers to a range over which a magnet brush rises on a developer carrier and contacts the image carrier.

The developer carrier is generally made up of a hollow cylindrical sleeve or developing sleeve and a magnet roller surrounded by the sleeve. The magnet roller forms a magnetic field for causing the developer deposited on the sleeve to rise in the form of a head. When the developer rises on the sleeve, carrier particles contained therein rise along magnetic lines of force generated by the magnet roller. Charged toner particles are deposited on each of such carrier particles. The magnet roller has a plurality of magnetic poles formed by rod-like magnets and including a main magnetic pole for causing the developer to rise in the developing region.

In the above configuration, when at least one of the sleeve and magnet roller moves, it conveys the developer forming a head thereon. The developer brought to the developing region rises in the form of a brush chain along the magnetic lines of force generated by the main magnetic pole. The brush chain or head contacts the surface of the image carrier while yielding itself. While the brush chain or head sequentially rubs itself against a latent image formed on the image carrier on the basis of a difference in linear velocity between the developer carrier and the sleeve, the toner is transferred from the developer carrier to the image carrier.

It has been customary to apply a lubricant to the image carrier or a process unit around it for insuring high quality images over a long time. If the image carrier has a great coefficient of friction, then vermicular omission occurs in an image portion where much toner is deposited, e.g., at the center of a line image at an image transfer stage. The ratio of such local omission noticeably varies in accordance with the fluidity of the toner that is dependent on, e.g., environment. Further, at a cleaning stage, a cleaning blade is entrained by the image carrier and fails to clean the image carrier. This not only cause black stripes to appear in an image, but also causes the cleaning blade to wear at an unexpected rate. By applying a lubricant to, e.g., the image carrier, it is possible to reduce friction acting between the image carrier and the cleaning blade and between the image carrier and an image transferring member and therefore to reduce the peel-off of the photoconductive layer of the image carrier. The lubricant therefore solves the above problems and extends the life of the image carrier. In addition, the lubricant obviates annoying sound.

However, the problem with the lubricant is that it lowers the coefficient of friction of the image carrier and therefore the amount of toner to deposit on the image carrier, preventing sufficient image density from being achieved. To solve this problem, tonality must be corrected by varying a bias for development or the power of a laser beam. Such correction needs extremely sophisticated control and therefore increases cost. Further, when adhesion between the toner and the image carrier and the force of the magnet brush rubbing the image carrier are brought out of balance, dots forming a halftone portion are locally lost, resulting in a granular image. Moreover, a ratio of the linear velocity of the sleeve to that of the image carrier cannot be increased because the trailing edge of a halftone image would be lost due to counter charge and the force of the magnet brush acting on the carrier.

Japanese patent application Nos. 11-39198, 11-128654 and 11-155378, for example, propose image forming apparatuses constructed to protect even a low contrast image from the omission of a trailing edge for thereby insuring desirable image density and quality. However, there is an increasing demand for an image forming apparatus capable of further improving image density and quality.

Technologies relating to the present invention are also disclosed in, e.g., Japanese patent laid-open publication Nos. 5-257387, 8-101584, 8-202226, 9-34261, 9-127793, 2000-10419, 2000-19858, 2000-47523, 2000-47524, and 2000-305360.

SUMMARY OF THE INVENTION

It is therefore an object of the present invention to provide an image forming apparatus capable of insuring a uniform halftone image, preventing the trailing edge of an image from being lost, and faithfully reproducing even a horizontal line.

In accordance with the present invention, an image forming apparatus includes a developing device including a main magnetic pole for causing a developer to magnetically deposit on the outer periphery of a developer carrier in the form of a magnet brush. An image carrier is located to face the developing device. The image carrier has a coefficient of friction of 0.5 or below. A flux density in the normal direction has an attenuation ratio of 40% or above, as measured in a developing region where the magnet brush contacts the image carrier.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
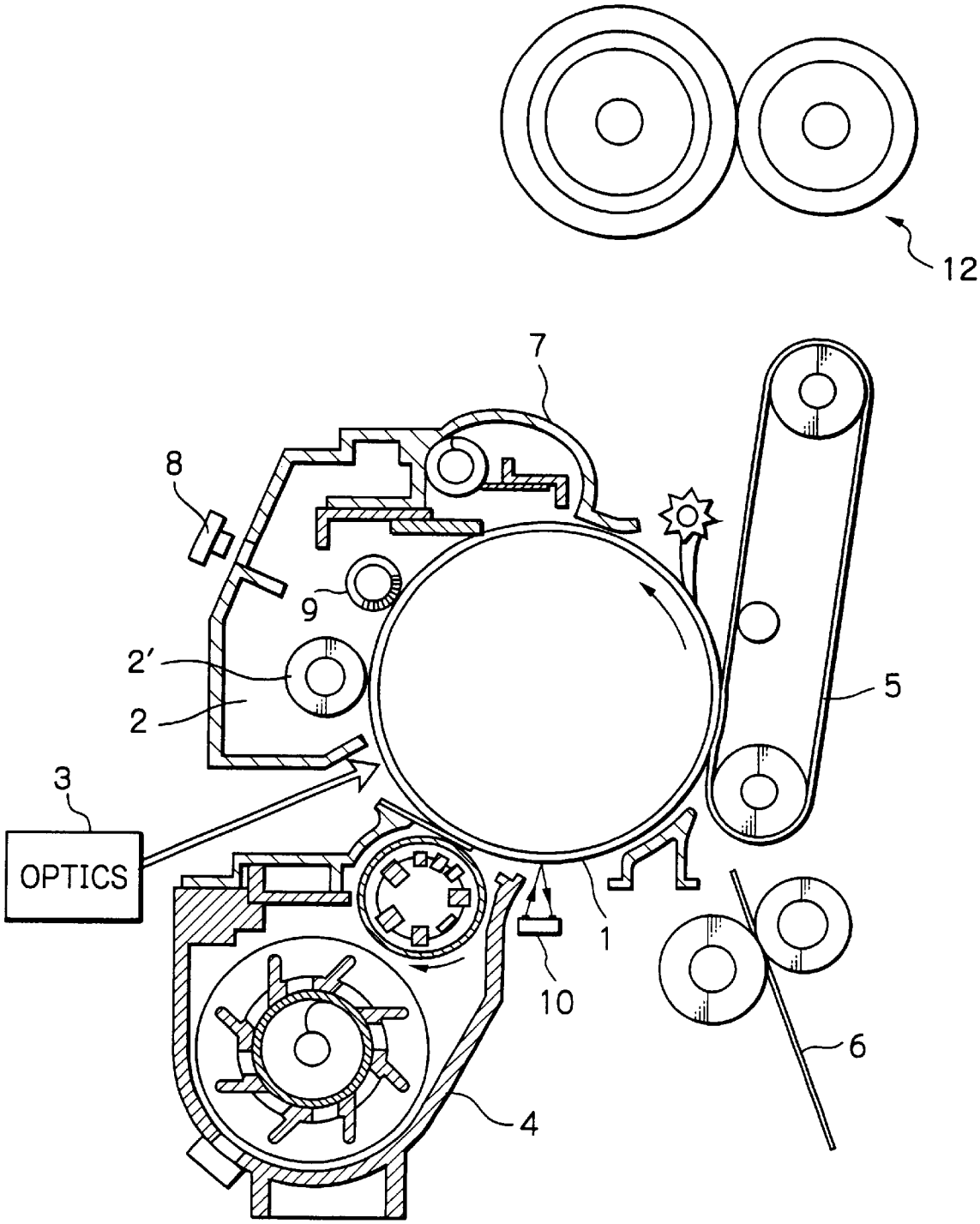
FIG. 1 is a view showing an image forming apparatus embodying the present invention.

Referring to FIG. 1, an image forming apparatus embodying the present invention is shown. As shown, the apparatus includes an image carrier implemented as a photoconductive drum 1. Sequentially arranged around the drum 1 are a charger 2, laser optics 3, a developing device 4, an image transferring device 5, a drum cleaner 7, and a discharge lamp 8. The charger 2 uniformly charges the surface of the drum 1. The laser optics 3 scans the charged surface of the drum 1 with a laser beam for thereby forming a latent image. The developing device 4 develops the latent image with charged toner to thereby form a corresponding toner image. The image transferring device 5 transfers the toner image from the drum 1 to a paper sheet or similar recording medium 6. The drum cleaner 7 removes toner left on the drum 1 after image transfer, and then the discharge lamp 8 dissipates charge left on the drum 1.

Assume that the apparatus with the above construction forms a toner image by negative-to-positive development. Then, a charge roller 2' included in the charger 2 uniformly charges the surface of the drum 1 to negative polarity, e.g., −950 V. The laser optics 3 forms a latent image on the charged surface of the drum 1; a potential of, e.g., −150 V is deposited on a black, solid image portion. The developing device 5 to which a bias of, e.g., −600 V is applied develops the latent image with toner to thereby produce a corresponding toner image. The image transfer device 5, which may include a belt, transfers the toner image from the drum 1 to the paper sheet 6 fed from a tray not shown. At this instant, a peeler 11 peels off the paper sheet 6 electrostatically adhering to the drum 1. A fixing device 12 fixes the toner image on the paper sheet 6. Subsequently, the drum cleaner 7 removes and collects the toner left on the drum 1 after the image transfer from the drum 1 to the paper 6. The discharge lamp 8 then initializes the drum 1 so as to prepare it for the next image forming cycle.

Figure 2:
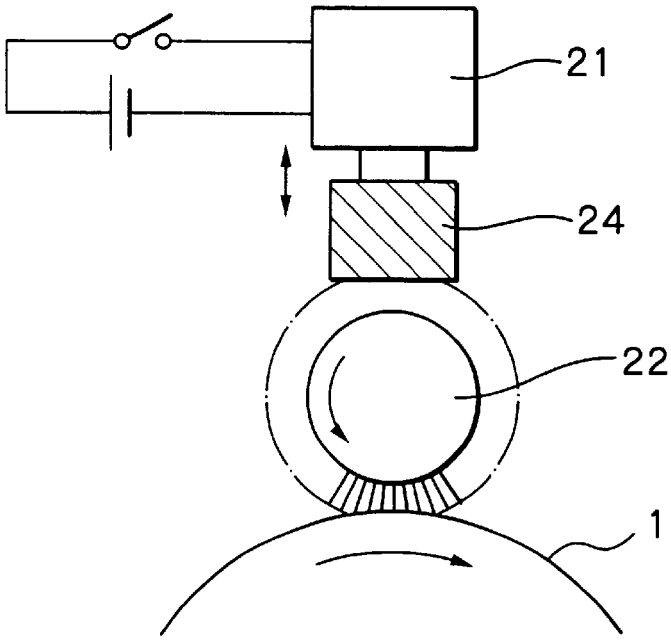
FIG. 2 is a view showing a specific configuration of a lubricator included in the illustrative embodiment.

A lubricator or lubricating member 9 is positioned in the charger 2. As shown in FIG. 2 specifically, the lubricator 9 includes a solid lubricant 24 and a jig 21 supporting the lubricant 24 via a spring. Such a lubricator may be included in the drum cleaner 7 or any other desired device as well.

The lubricant 24 should preferably have low surface energy. In addition, the lubricant 24 should preferably be chemically inactive and thermally stable. For example, the lubricant 24 may be selected from a group of fatty acid metals including zinc stearate, barium stearate, iron stearate and magnesium stearate and a group of fluorine-contained polymers including polytetrafluoroethylene (PTFE) and tetrafluoroethylene-perfluoroalkylvinylether (PFA). Inorganic, fine particles of fatty acid metals are chargeable to positive polarity while fluorine-contained polymers are chargeable to negative polarity. Fatty acid metals and fluorine-contained polymers both are chemically inactive and remain stable with respect to the image carrier and toner.

Inorganic fine particles of zinc stearate, for example, are often used in a positive-to-positive development system. In a positive-to-positive development system, a charger charges an image carrier to negative polarity. Subsequently, exposure causes the negative charge to disappear in a non-image portion while maintaining it in an image portion, thereby forming a latent image. Toner charged to positive polarity deposits on the latent image. The inorganic fine particles mentioned above are charged to the same polarity as the toner.

A fluorine-contained polymer is used in a negative-to-positive or reversal development system. In this development system, a charger charges an image carrier to negative polarity. Subsequently, exposure lowers the potential in the image portion of the image carrier, thereby forming a latent image. Toner charged to negative polarity deposits on the latent image on the basis of a difference in potential between the toner and the latent image. The toner charged to negative polarity repulses the fluorine-contained polymer, or lubricant, and therefore does not cohere.

As stated above, the inorganic fine particles chargeable to positive polarity and the fluorine-contained polymer chargeable to negative polarity should preferably be applied to positively charged toner and negatively charged toner, respectively. In the illustrative embodiment, use is made of zinc stearate that is easy to mold and has no influence on image formation.

As shown in FIG. 2, a biasing member, not shown, presses the lubricant 24 against a brush 22 and is shaved off by the brush 22. The force of the biasing member and therefore the amount of application of the lubricant 24 to the drum 1 is variable. This allows the coefficient of friction of the surface of the drum 1 and that of the surface of the image transferring device 5 to vary. The lubricant 24 is, e.g., PTFE belonging to upper part of negative charge series and is charged to negative polarity when subjected to friction. The drum 1 in rotation conveys the lubricant applied thereto to the charge roller 2'. At this instant, the lubricant does not deposit on the charge roller 2' because a negative voltage, e.g., −1.6 kV is applied to the charge roller 2'. The drum 1 further conveys the lubricant to a developing region where the drum 1 faces the developing device 4.

The developing device 4 collects part of the lubricant due to the difference between the potential of −950 V deposited on the drum 1 and the bias of −600 V for development. Specifically, the developing device 4 collects about 35% of the lubricant deposited on the drum 1. Subsequently, the image transferring device 5 collects about 44% of the lubricant deposited on the drum 1 because a constant current of +10 $\mu$A is applied to the image transferring device 5. As a result, about 21% of the lubricant is left on the drum 1 and conveyed to the drum cleaner 7.

The above procedure is repeated to lower the coefficient of friction of the surface of the drum 1 to one determined by the condition in which the lubricator 9 contacts the drum 1. The coefficient of friction becomes constant when the amount of the lubricant applied to the drum 1 and the amount of the same collected by the developing device 4 and image transferring device 5 are balanced.

Figure 3:
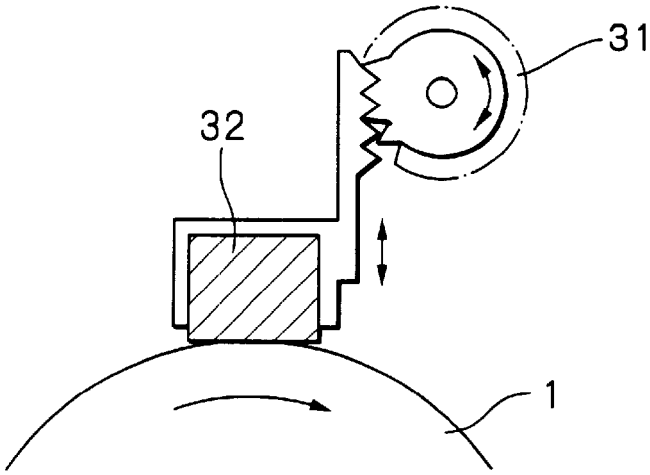
FIG. 3 is a view showing another specific configuration of the lubricator.

In an alternative arrangement, the ratio of the linear velocity of the brush 22 to that of the drum 1 is varied in order to vary the amount of the lubricant 24 to be applied to the drum 1. FIG. 3 shows another alternative arrangement for lubrication. As shown, a jig 31, which plays the role of a pressing member at the same time, directly presses a solid lubricant 32 against the drum 1. The pressing force of the jig 31 is variable to vary the amount of the lubricant 32 to be applied to the drum 1 and the coefficient of friction of the drum 1. A relation between the amount of the lubricant 32 and the coefficient of friction of the drum will be described in detail later.

In the illustrative embodiment, the lubricator applies the lubricant to the drum 1 in order to lower the coefficient of friction of the drum 1. It was experimentally found that the illustrative embodiment was effective even in a system in which the coefficient of friction is as low as in the illustrative embodiment due to differences in the composition of the drum and the method of production.

Referring again to FIG. 1, a photosensor 10 adjoins the developing device 4 and is made up of a light emitting element and a light-sensitive element. The photosensor 10 senses the density of a reference pattern formed on the drum 1. The output of the photosensor 10 is sent to a controller, not shown, including a CPU (Central Processing Unit). The controller controls parameters relating to the amount of the lubricant and development in accordance with the density sensed by the photosensor 10.

Figure 4:
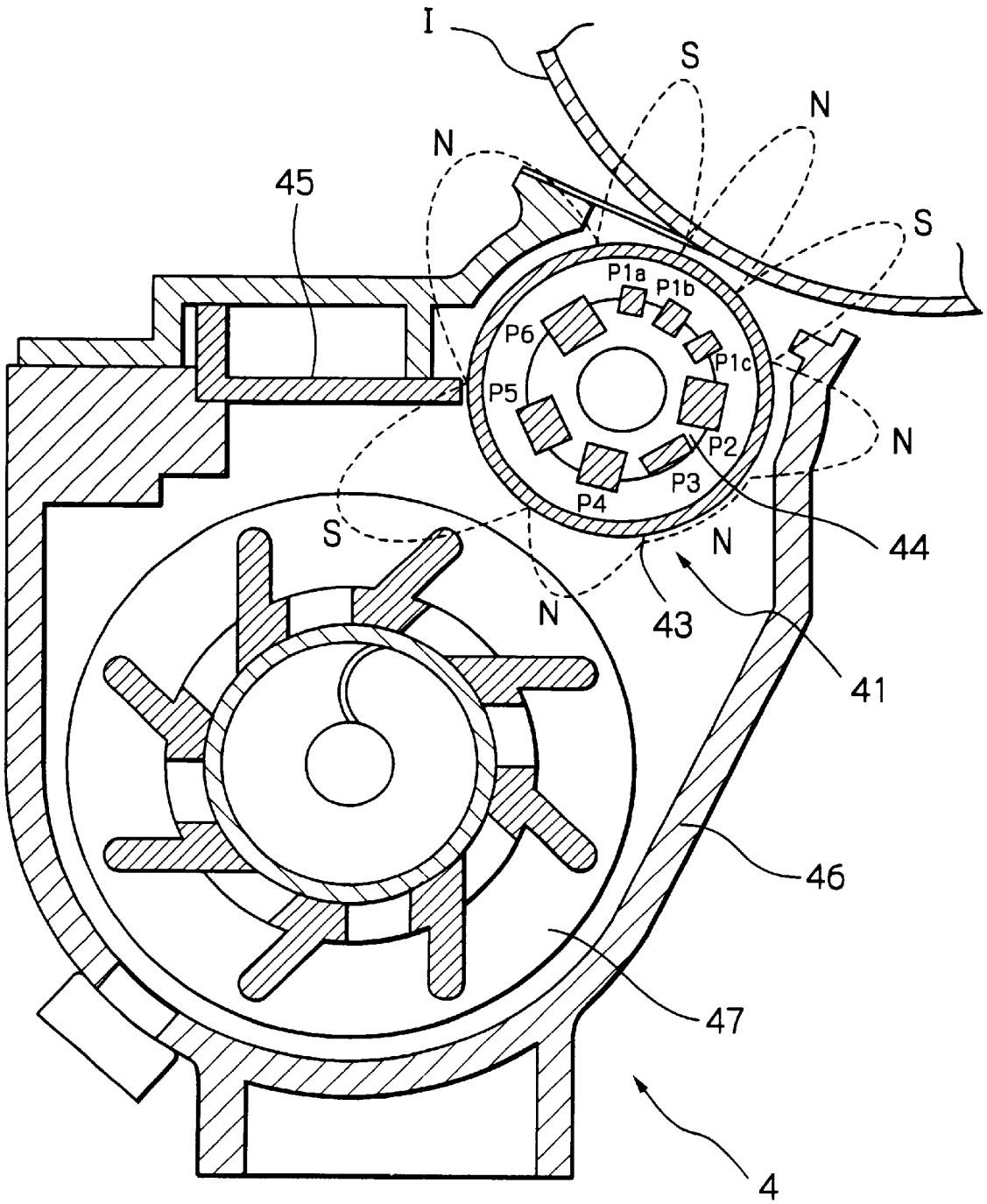
FIG. 4 is a view showing a developing device also included in the illustrative embodiment.

Reference will be made to FIG. 4 for describing the developing device 4 in detail. As shown, a developing roller or developer carrier 41 is disposed in the developing device 4 and adjoins the drum 1. The developing roller 41 and drum 1 form a developing region therebetween. The developing roller 41 includes a hollow cylindrical sleeve 43 formed of aluminum, brass, stainless steel, conductive resin or similar nonmagnetic material. A drive mechanism, not shown, causes the sleeve 43 to rotate clockwise as seen in FIG. 4. In the illustrative embodiment, the drum 1 has a diameter of 60 mm and moves at a linear velocity of 240 mm/sec while the sleeve 43 has a diameter of 20 mm and moves at a linear velocity of 600 mm/sec. Therefore, the linear velocity ratio of the sleeve 43 to the drum 1 is 2.5. A gap of 0.4 mm for development is formed between the drum 1 and the sleeve 43.

A doctor blade 45 is positioned upstream of the developing region in the direction in which the sleeve 43 conveys the developer (clockwise in FIG. 4). The doctor blade 45 regulates the height of the head of the developer chain, i.e., the amount of the developer deposited on the sleeve 43. A doctor gap between the doctor blade 45 and the sleeve 43 is selected to be 0.4 mm. A screw 47 is positioned at the side opposite to the drum 1 with respect to the developing roller 41 in order to scoop up the developer stored in a casing 46 while agitating it.

A magnet roller 44 is fixed in place within the sleeve 43 for causing the developer deposited on the sleeve 43 to rise in the form of a head. Specifically, a carrier contained in the developer forms chain-like heads on the sleeve 43 along magnetic lines of force normal to the magnet roller 44. Charged toner also contained in the developer deposits on the heads of the carrier, forming a magnet brush. The sleeve 43 in rotation conveys the magnet brush clockwise.

The magnet roller 44 has a plurality of magnets or magnetic poles. Specifically, a main magnet P1*b* causes the developer to rise in the form of ahead in the developing region. Auxiliary magnets P1*a* and P1*c* help the main magnet P1*b* form a magnetic force. A magnet P4 causes the developer to deposit on the sleeve 43. Magnets P5 and P6 serve to convey the developer deposited on the sleeve 43 to the developing region. Further, magnets P2 and P3 serve to convey the developer over a region following the developing region. The magnets P1*b* through P3 each are oriented in the radial direction of the sleeve 43. While the magnet roller 44 is shown as having eight magnets, additional magnets or magnetic poles may be arranged between the magnet P3 and the doctor blade 45 in order to enhance the ability to scoop the developer and the ability to follow a black solid image. For example, ten to twelve magnets may be arranged in total.

As shown in FIG. 4, the magnets P1*a*, P1*b* and P1*c* (main magnet group P1 collectively) are sequentially arranged in this order from the upstream side to the downstream side, and each has a relatively small cross-sectional area. While the main magnet group P1 is formed of an alloy of rare-earth metal, use may be made of a samarium alloy, particularly a samarium-cobalt alloy. Typical of magnets formed of rare-earth metal alloys are an iron-neodium-boron alloy magnet with which the maximum energy product of 358 kJ/m$^3$ is achievable and an iron-neodium-boron alloy bond magnet with which the maximum energy product of 80 kJ/cm$^3$ is achievable. A magnet formed of such a material can provide the roller surface with a required magnetic force even when greatly reduced in size. The maximum energy product available with conventional magnets formed of ferrite and ferrite bond are not greater than about 36 kJ/m$^3$ and about 20 kJ/m$^3$, respectively. If the diameter of the sleeve 43 is allowed to be increased, the half-width may be reduced by using a ferrite magnet or a ferrite bond magnet having a great size or by thinning the tip of the magnet adjoining the sleeve 43. The half-width refers to an angular range between points where the magnetic force in the normal direction or the flux density is one-half of he peak or maximum magnetic force or the peak flux density of a magnetic force distribution in the normal direction. For example, when a n-pole magnet has the maximum magnetic force of 120 mT in the normal direction, the half value is 60 mT. The half-width is sometimes referred to as a center half-angle or a center half-angle width.

Figure 5:
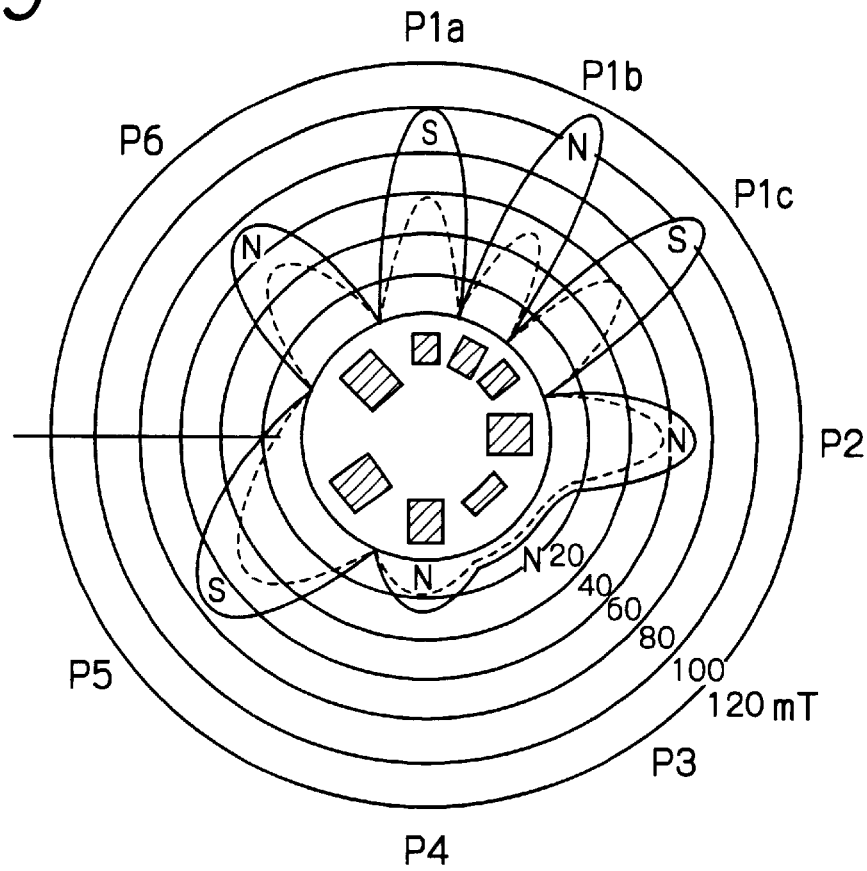
FIG. 5 is a chart showing the magnetic force distribution and sizes thereof particular to a magnet roller included in the developing device.

In the illustrative embodiment, the main magnet P1*b* and magnets P4, P6, P2 and P3 are magnetized to the n-pole while the magnets P1*a*, P1*c* and P5 are magnetized to the s-pole. FIG. 5 is a circle chart showing flux densities in the normal direction determined by measurement. As shown, the main magnet P1*b* had a magnetic force of 85 mT (millitesla) or above in the direction normal to the developing roller 41. It was experimentally found that when the magnet P1*c* downstream of the main magnet P1*b* had a magnetic force of 60 Tm or above, defective images including one with carriers deposited thereon were obviated. Magnetic forces of 60 Tm or below caused carrier particles to deposit on images. A tangential magnetic force is the magnetic force relating to carrier deposition. While the magnetic forces of the magnets P1*b* and P1*c* should be increased to increase the above tangential force, carrier deposition can be sufficiently reduced if either one of them is sufficiently great. The magnets P1*a*, P1*b* and P1*c* each were 2 mm wide. In this condition, the half-width of the magnet P1*b* was 16°.

Figure 6:
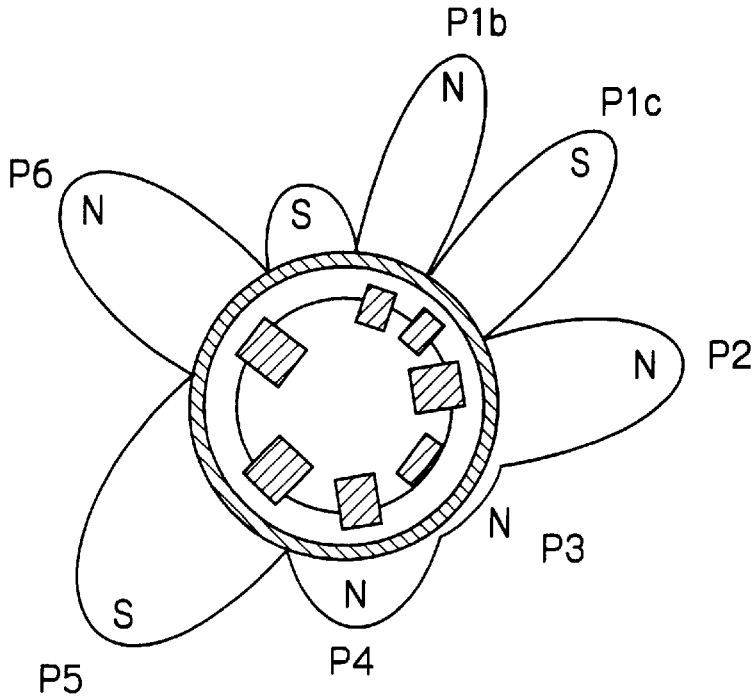
FIG. 6 is a view showing a magnetic force distribution that occurs when the magnet roller lacks one of auxiliary magnetic poles.

As shown in FIG. 6, when only the auxiliary magnet P1*c* was located downstream of the main magnet P1*b*, the magnetic force of the main magnet P1*b* was reduced by several percent although the half-width of the main magnet P1*b* remained the same. By further reducing the width of the magnet, it is possible to further reduce the half-width, as determined by experiments. When the magnet was 1.6 mm wide, the main pole had a half-width of 12°. The half-widths of the main pole above 25° resulted in defective images.

Figure 7:
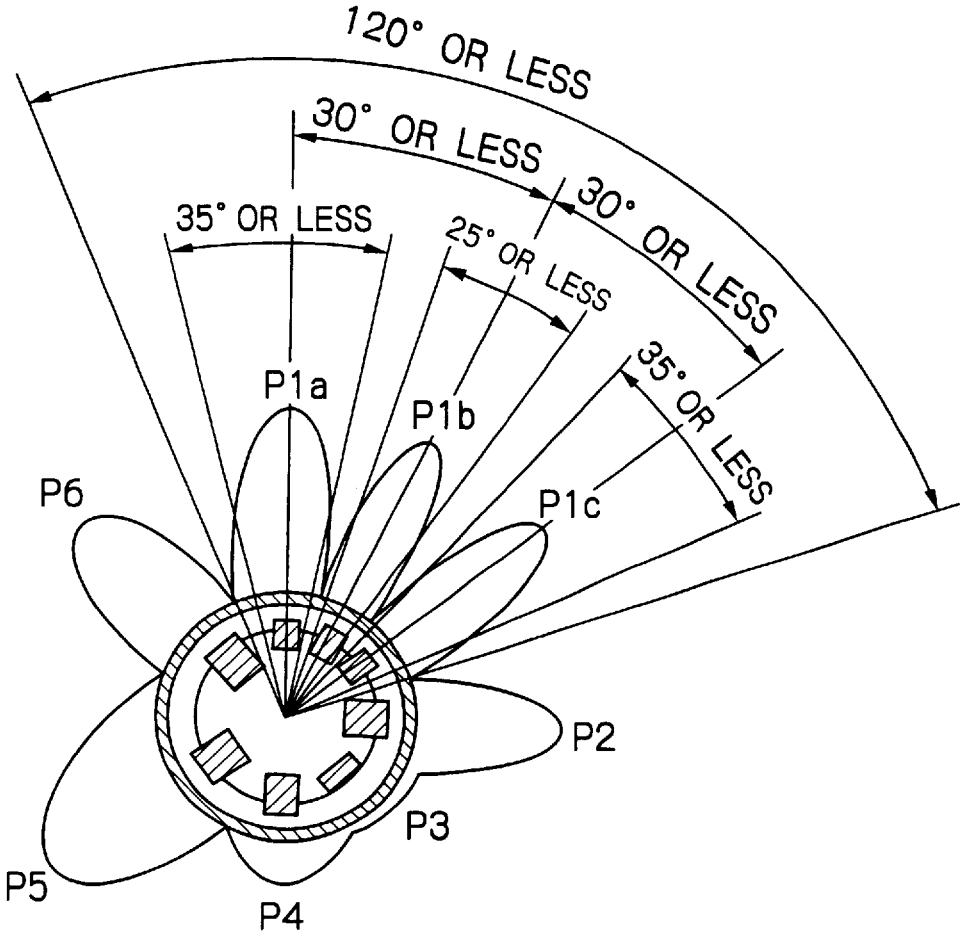
FIG. 7 is a view showing a positional relation between a main magnetic pole and auxiliary magnetic poles included in the magnet roller.

FIG. 7 shows the positional relation between the main magnet P1*b* and the auxiliary magnets P1*a* and P1*c*. As shown, the auxiliary magnets P1*a* and P1*c* each are provided with a half-width of 35° or less. Because the magnets P6 and P2 positioned outward of the auxiliary magnets P1*a* and P1*c*, respectively, each have a great half-width, the half-width at each of the magnets P1*a* and P1*c* cannot be reduced relative to the main magnet P1*b*. Further, the angle between the main magnet P1*b* and each of the auxiliary magnets P1*a* and P1*c* is selected to be 30° or less. In the illustrative embodiment in which auxiliary magnetic poles are formed at both sides of the main magnetic pole, the half-width at the main pole is selected to be 16°, and therefore the above angle is selected to be 25°. In addition, polarity transition points (0 mT and where the s-pole and n-pole replace each other) between the auxiliary magnets P1 and P1*c* and the magnets P2 and P6 make an angle of 120° or less therebetween.

When the conditions described above are satisfied, a nip for development that is greater than the particle size of the developer, but smaller than 2 mm, can be formed. Such a nip obviates the omission of the trailing edge of an image and allows even thin horizontal lines and single-dot or similar small images to be faithfully reproduced.

Further, when the root portion of the magnet brush formed on the sleeve by the main magnet P1*b* is 2 mm wide or less, there can be implemented a nip for development that is 2 mm wide or less.

In the configuration described above, the developer stored in the casing 46 is agitated and charged. The pole P4 scoops up the charged developer to the sleeve 43. The sleeve 43 conveys the developer to the developing region under the forces of the poles P5 and P6. The main pole P1*b* causes the developer to rise in the form of a magnet brush.

Referring again to FIG. 5, showing a magnetic force pattern in the normal direction, solid curves are representative of flux densities measured on the surface of the sleeve 43 while phantom curves are representative of flux densities measured at a distance of 1 mm from the surface of the sleeve 43. For measurement, a gauss meter HGM-8300 and an axial probe type A1 available from ADS were used.

In the illustrative embodiment, the flux density of the main magnet P1*b* in the direction normal to the surface of the sleeve 43 was measured to be 117 mT on the surface of the sleeve 43 or 54.4 mT at the distance of 1 mm from the same. That is, the flux density varied by 62.5 mT. In this case, the attenuation ratio of the flux density in the direction normal to the sleeve 43 was 53.5%. It is to be noted that the attenuation ratio is produced by subtracting the peak flux density at the position spaced by 1 mm from the sleeve surface from the peak flux density on the sleeve surface and then dividing the resulting difference by the latter peak flux density.

The auxiliary magnet P1*a* upstream of the main magnet P1*b* had a flux density of 106.2 mT in the direction normal to the sleeve surface on the sleeve surface or a flux density of 56.6 mT at the position 1 mm spaced from the same; the flux density varied by 49.6 mT, and the attenuation ratio was 46.7%. The other auxiliary magnet P1*c* downstream of the main magnet P1*b* had a flux density of 55.9 mT in the direction normal to the sleeve surface on the sleeve surface or a flux density of 55.9 mT at the position 1 mm spaced from the same; the flux density varied by 43.5 mT, and the attenuation ratio was 43.8%. In the illustrative embodiment, only the brush portion formed by the main magnet P1*b* contacts the drum 1 and develops a latent image formed on the drum 1. In this connection, the magnet brush was about 1.5 mm long at the above position when measured without contacting the drum 1. Such a magnet brush was shorter than conventional length and therefore more dense than a conventional magnet brush.

For a given distance between the developer regulating member and the sleeve, i.e., for a given amount of developer to pass the regulating member, the illustrative embodiment made the magnet brush shorter and more dense than the conventional magnet brush at the developing region, as determined by experiments. This will also be understood with reference to FIG. 5. Because the flux density in the normal direction measured at the distance of 1 mm from the sleeve surface noticeably decreases, the magnet brush cannot form a chain at a position remote from the sleeve surface and is therefore short and dense. In this connection, the flux density available with the main pole of a conventional magnet roller was 90 mT on the sleeve surface or 63.9 mT at the distance of 1 mm from the sleeve surface; the flux density varied by 26.1 mT, and the attenuation ratio was 29%.

With the magnetic force described above, it is possible to make the nip for development narrow and stable and therefore to prevent the developer from staying at the position upstream of the nip. This successfully obviates the omission of the trailing edge of an image and the thinning of a horizontal line, thereby insuring an attractive image with uniform dots.

Figure 8:
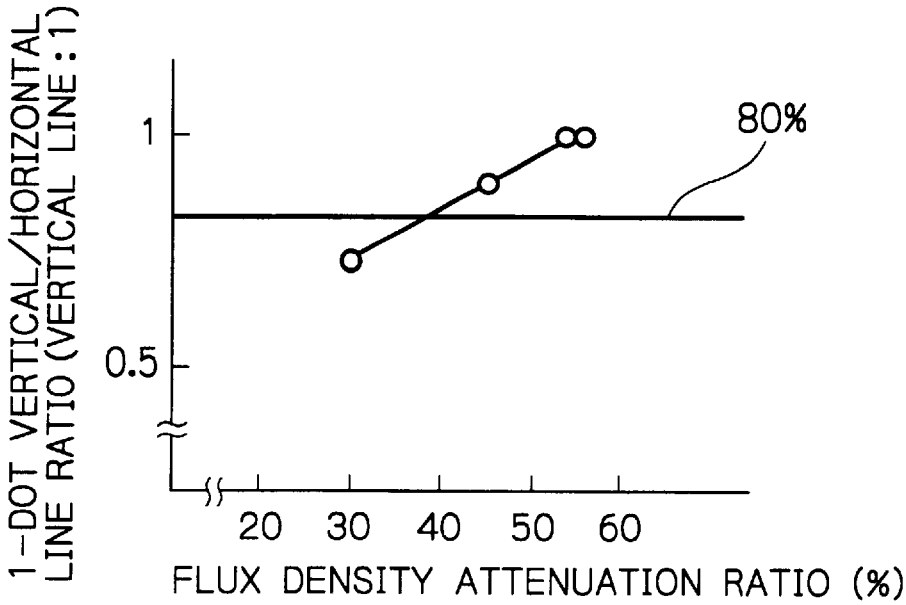
FIG. 8 is a graph showing a relation between a ratio in width between a single-dot vertical line and a single-dot horizontal line and the attenuation ratio of the flux density of the main magnetic pole.

FIG. 8 shows a relation between a ratio between the width of a vertical single-dot line and that of a horizontal single-dot line and the attenuation ratio of the flux density of the main pole P1*b* in the normal direction. If the above ratio is 1, then the horizontal and vertical lines have the same width. The thinning of the horizontal line is conspicuous in the range below an 80% line shown in FIG. 8. As FIG. 8 indicates, the magnet roller of the illustrative embodiment obviates the thinning of a horizontal line. It follows that the omission of the trailing edge of an image and the thinning of a horizontal line both are obviated if the attenuation ratio of the flux density is 40% or above. This is also true with the poles adjoining the main pole, as determined by experiments.

Again, the flux density was measured by use of the previously mentioned gauss meter HGM-8300, axial probe A1, and circle chart recorder. Specifically, to measure the flux density on the surface of the sleeve, the axial probe was held in contact with the sleeve. While the magnet roller was rotated by 360°, the flux density was measured by a step of 0.1° and recorded in the circle chart recorder. Subsequently, the tip of the axial probe was lifted by 1 mm away from the surface of the sleeve in order to measure the flux density at a position spaced from the above surface by 1 mm.

Figure 9:
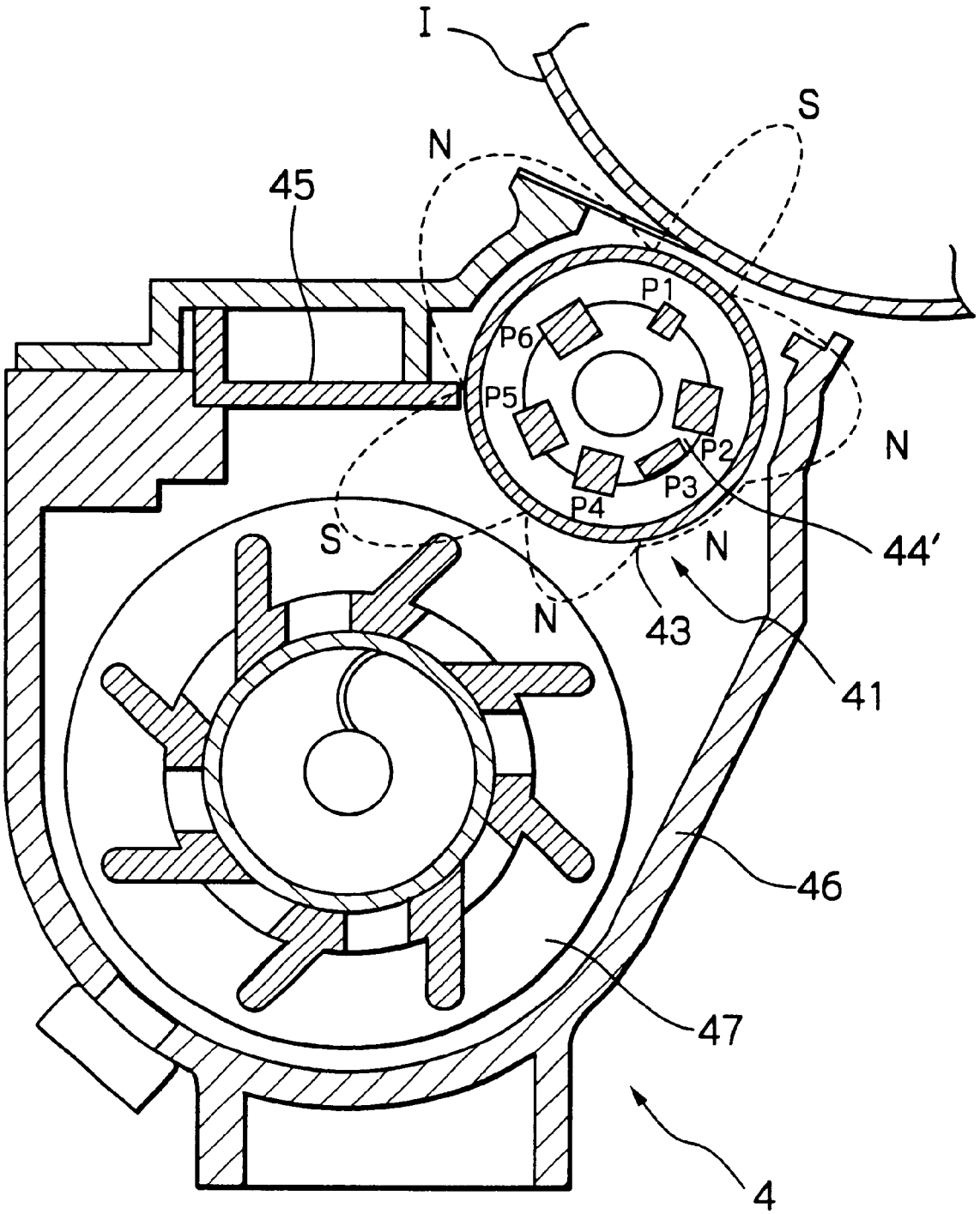
FIG. 9 is a view showing a magnet roller lacking the auxiliary magnetic poles.

FIG. 9 shows another specific configuration of the magnet roller. The developing device shown in FIG. 9 is identical with the developing device shown in FIG. 4 except for the configuration of the magnet roller. As shown, a magnet roller 44' differs from the magnet roller 44 in that it lacks the poles P1*a* and P1*c* shown in FIG. 4. Specifically, the magnet roller 44' has a main pole P1 and the poles P2 through P6 stated earlier. The magnet forming the main pole P1, like the magnet forming the main pole P1*b*, is formed of a rare earth metal alloy although it may alternatively be formed of, e.g., a samarium alloy.

Figure 10:
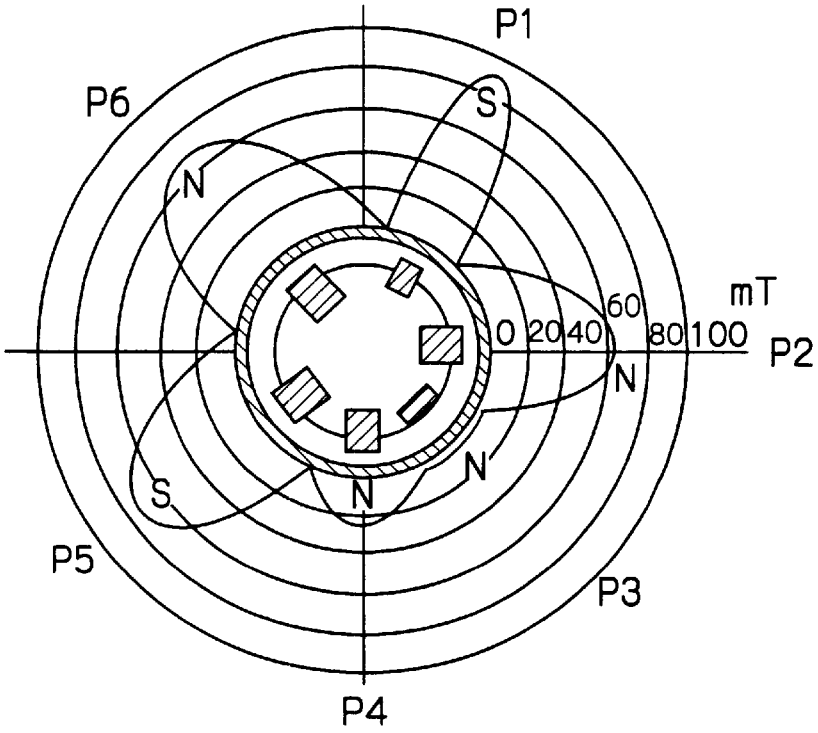
FIG. 10 is a chart showing the magnetic force distribution and sizes thereof particular to the magnet roller shown in FIG. 9.
Figure 11:
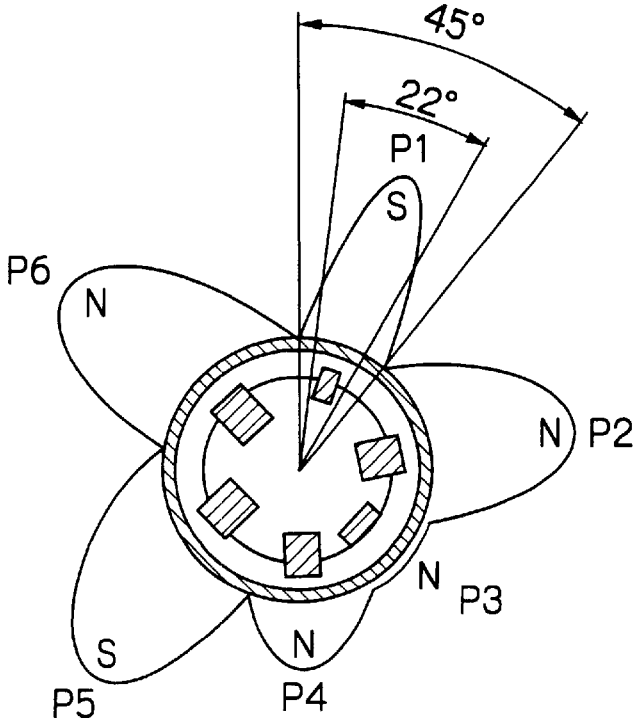
FIG. 11 is a view showing the half-width of a main magnetic pole and an angle between polarity transition points derived from the main pole and poles located outward of the main pole.

As shown in FIG. 10, the main pole P1 was implemented by a magnet whose magnetic force was 85 mT or above, as measured on the surface of the developing roller. Experiments showed that a magnetic force of 60 mT or above obviated defects including the deposition of the carrier. The magnet P1 was 2 mm wide and had a half-width or center half-angle of 22° (see FIG. 11). By further reducing the width of the magnet, it is possible to further reduce the half-width, as determined by experiments. When the magnet was 1.6 mm wide, the half-width was 16°. Half-widths above 25° brought about defective images. Polarity transition points between the main pole P1 and the poles P2 and P6 were selected to be 45° or less.

In the configuration shown in FIG. 9, the main magnet P1 had a flux density of 85 mT in the direction normal to the sleeve surface on the sleeve surface or a flux density of 39.5 mT at the position 1 mm spaced from the same; the flux density varied by 45.5 mT, and the attenuation ratio was 53.5%. Again, only the brush portion formed by the main magnet P1 contacts the drum 1 and develops a latent image formed on the drum 1. In this connection, the magnet brush was about 1.5 mm long at the above position when measured without contacting the drum 1. Such a magnet brush was shorter than conventional length and therefore more dense than a conventional magnet brush.

Figure 12:
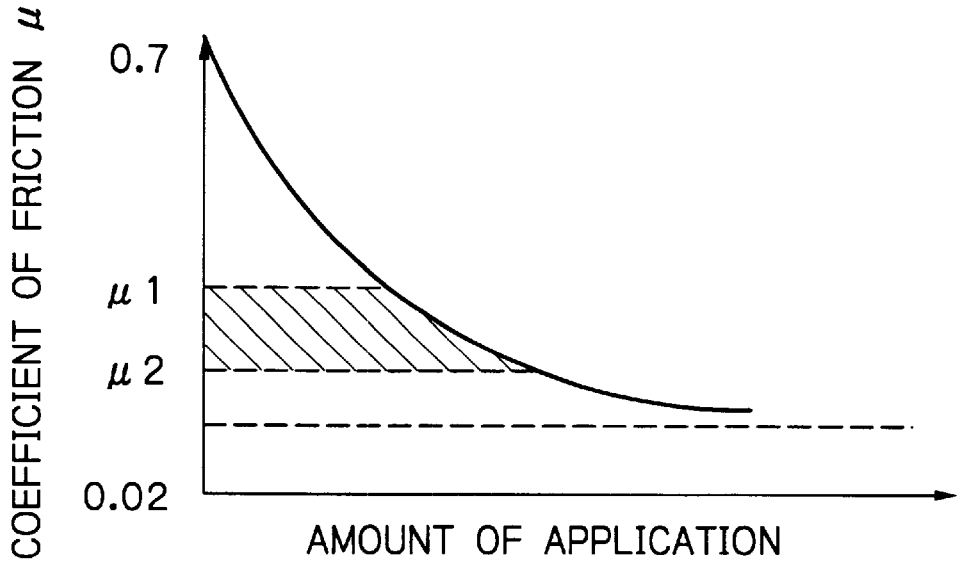
FIG. 12 is a graph showing a relation between the amount of a lubricant applied to a photoconductive element and the coefficient of friction of the surface of the photoconductive element.
Figure 13:
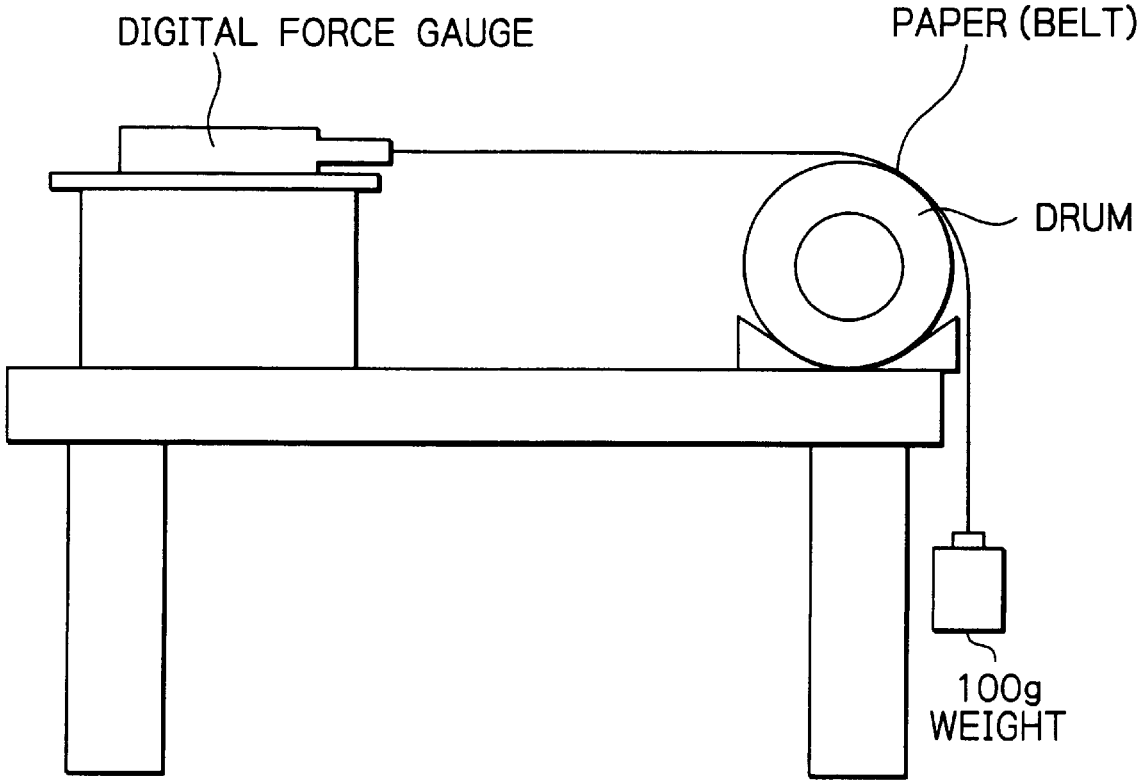
FIG. 13 is a view showing a specific arrangement used to measure the coefficient of friction of the photoconductive element.

The relation between the amount of lubricant applied and the coefficient of friction of the surface of the drum will be described with reference to FIG. 12. As shown, the coefficient of friction $\mu$ varies in accordance with the amount of the lubricant applied to the drum. The coefficient $\mu$ does not infinitely approach zero, but settles at a certain value. The coefficient $\mu$ is dependent on the composition and surface condition of the drum before the deposition of the lubricant as well as on ambient conditions, particularly humidity. In the illustrative embodiment, use was made of an Euler's method for measuring the coefficient $\mu$. FIG. 13 shows a specific arrangement used to measure the coefficient $\mu$. Measurement showed that when the coefficient $\mu$ was 0.7 before the application of the lubricant, the coefficient $\mu$ unlimitedly converged to 0.02 after the application. The result of measurement, however, depends on the measuring method and environment. In the illustrative embodiment, measurement was made at relative humidity of 65% and temperature of 23° C.

Figure 14:
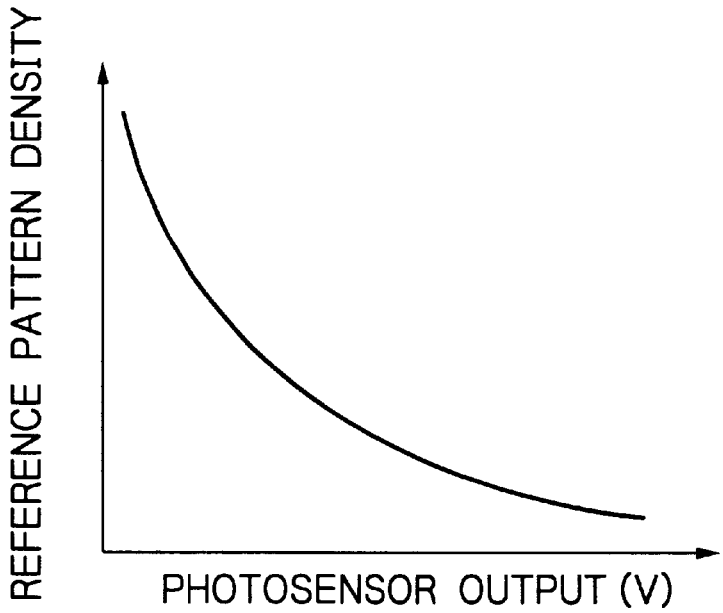
FIG. 14 is a graph showing a relation between the amount of toner deposited on the photoconductive element and the output of a reflection type photosensor.

FIG. 14 shows a relation between the amount of toner deposited on the drum and the output of the photosensor. A latent image sized, e.g., 2 cm×2 cm is formed on the drum as a reference pattern. The reference pattern should preferably be a halftone pattern highly sensitive to a change in condition although it may be replaced with a black, solid image.

Figure 15:
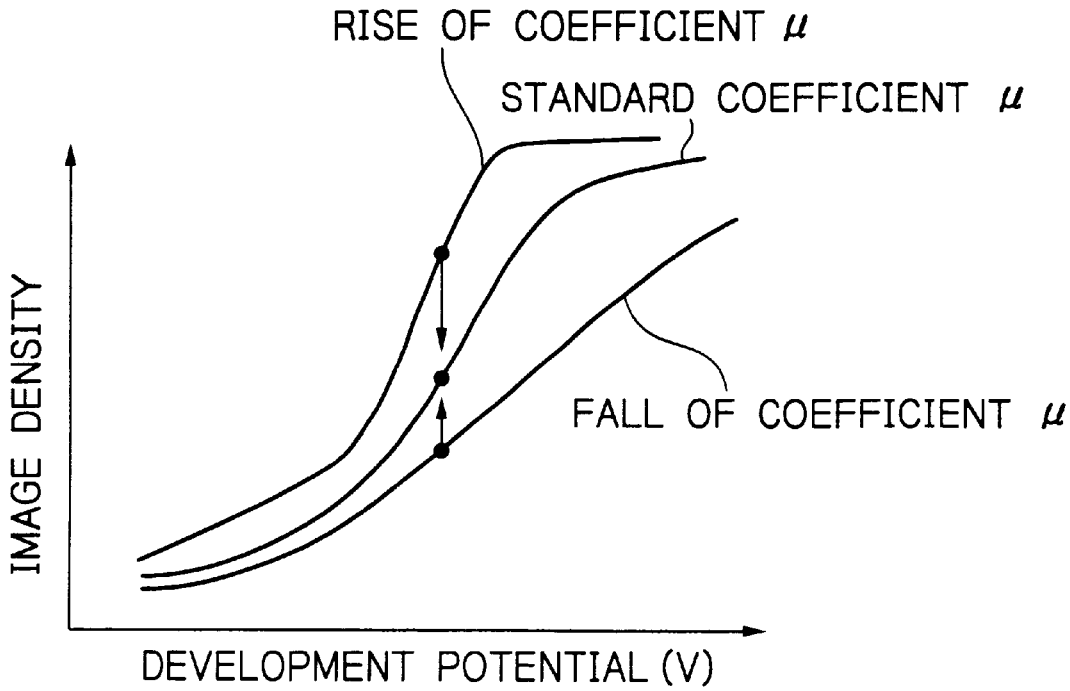
FIG. 15 is a graph showing a relation between the variation of the amount of the lubricant and a development gamma curve.
Figure 16:
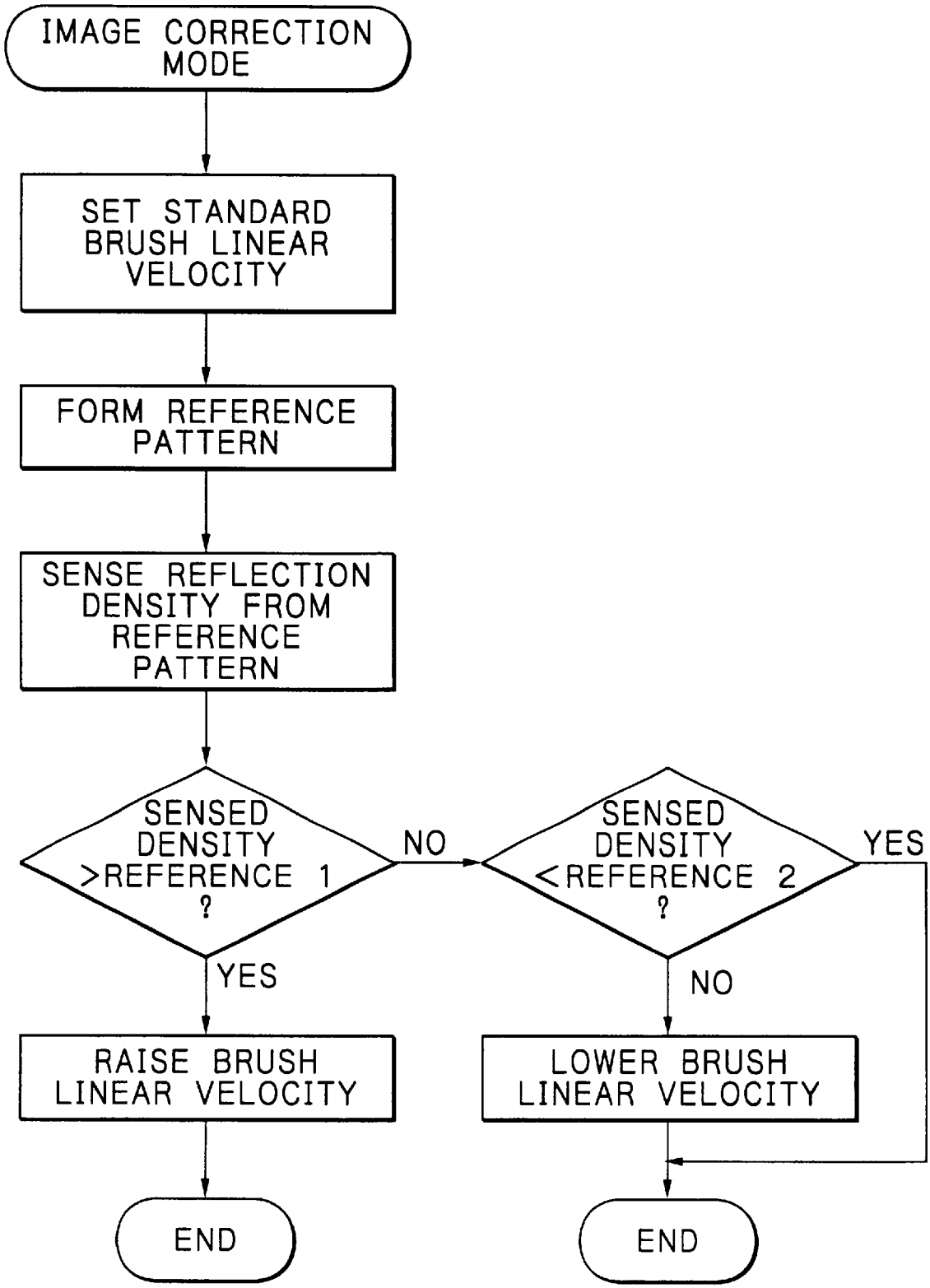
FIG. 16 is a flowchart demonstrating a specific procedure unique to the illustrative embodiment for controlling the amount of the lubricant to be applied.

As shown in FIG. 15, the amount of the lubricant applied to the drum has influence on a development gamma curved as well. In FIG. 15, the ordinate and abscissa indicate image density and development potential, respectively. As FIG. 15 indicates, the gamma curve rises above a designed gamma curve when the amount of the lubricant is short or falls below the designed gamma curve when it is excessive. It is therefore necessary to correct the amount of the lubricant immediately. FIG. 16 shows a specific procedure for controlling the amount of the lubricant. As shown, a reference density pattern is formed with the brush of the applicator being rotated at a standard linear velocity. The photosensor senses the reflection density of the reference pattern. If the sensed reflection density is higher than a first reference value (upper limit), then the linear velocity of the brush is increased. If the reflection density is higher than a second reference value (lower limit), then the linear velocity is reduced. As a result, the reflection density is confined in an adequate range, insuring a stable image at all times.

Figure 17:
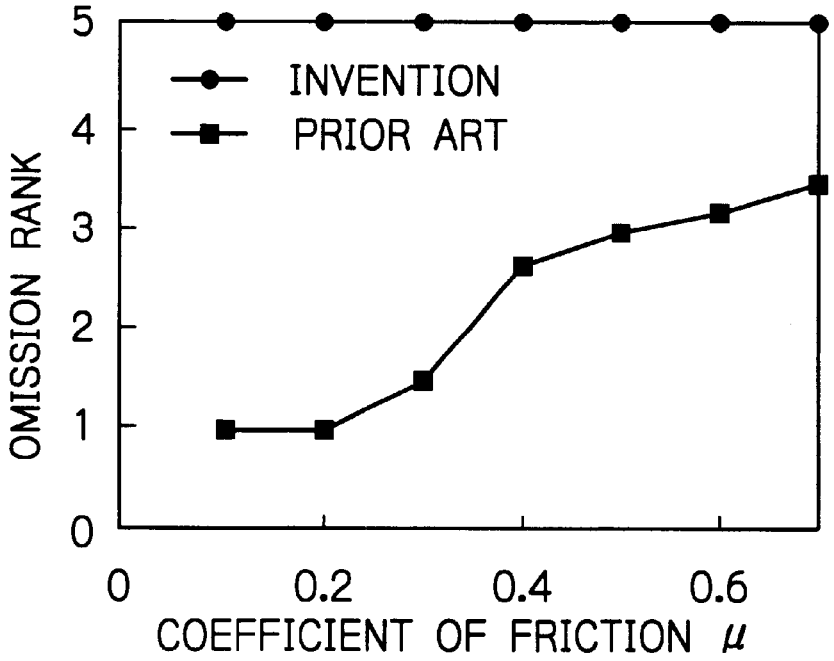
FIG. 17 is a graph showing the results of estimation relating to the omission of the trailing edge of an image and effected with respect to the coefficient of friction of the photoconductive element after the application of the lubricant.

We conducted a series of experiments with the magnet roller of the illustrative embodiment including the auxiliary electrodes and a conventional magnet roller whose pole for development has a half-width of 48°. FIG. 17 compares the magnet roller of the illustrative embodiment and the conventional magnet roller with respect to a relation between the coefficient $\mu$ and the omission of the trailing edge of an image. In FIG. 17, omission rank 5 indicates that omission did not occur at the trailing edge of an image at all while rank 1 indicates that the omission was most conspicuous. More specifically, rank 1 indicates that an image was lost over 4.2 mm from its trailing edge when the drum linear velocity was 200 mm/s, when the development gap was 0.35 mm, when the ratio of the linear velocity of the sleeve to that of the drum was 1.8, when an AC bias had a frequency of 9 kHz, and when the coefficient $\mu$ was 0.2. FIG. 17 plots the coefficient $\mu$ up to 0.7. When the coefficient $\mu$ was 0.6 or above, a 10,000 running test caused a cleaning blade to wear and caused toner filming to occur on the drum and lower image quality.

As shown in FIG. 17, the omission rank particular to the conventional magnet roller is 1 for the coefficient $\mu$ of 0.2. By contrast, the omission rank particular to the magnet roller of the illustrative embodiment is 5 even when the coefficient $\mu$ is varied from 0.5 to 0.1.

Figure 18:
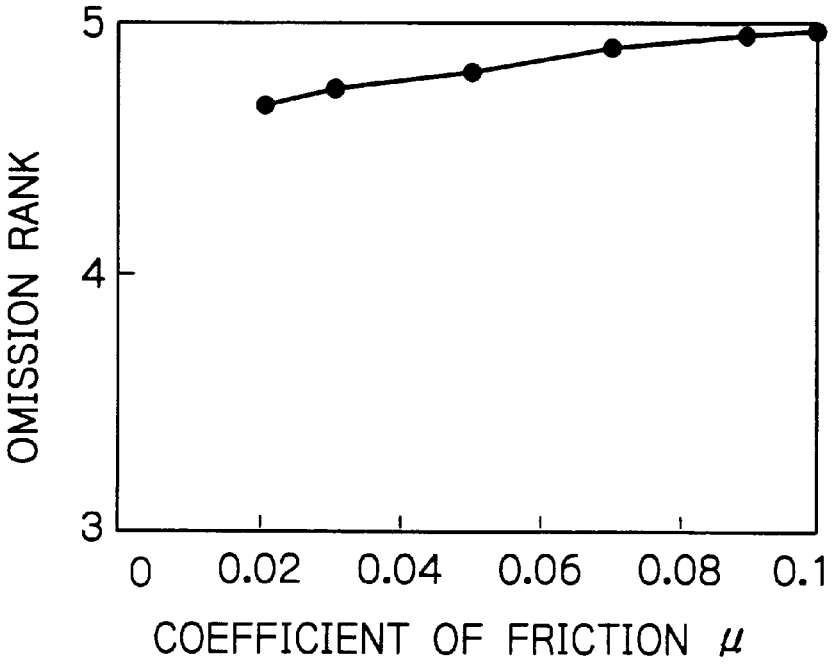
FIG. 18 is a graph showing the results of estimation of the omission of the trailing edge effected with the coefficient of friction of 0.1 or less.
Figure 19:
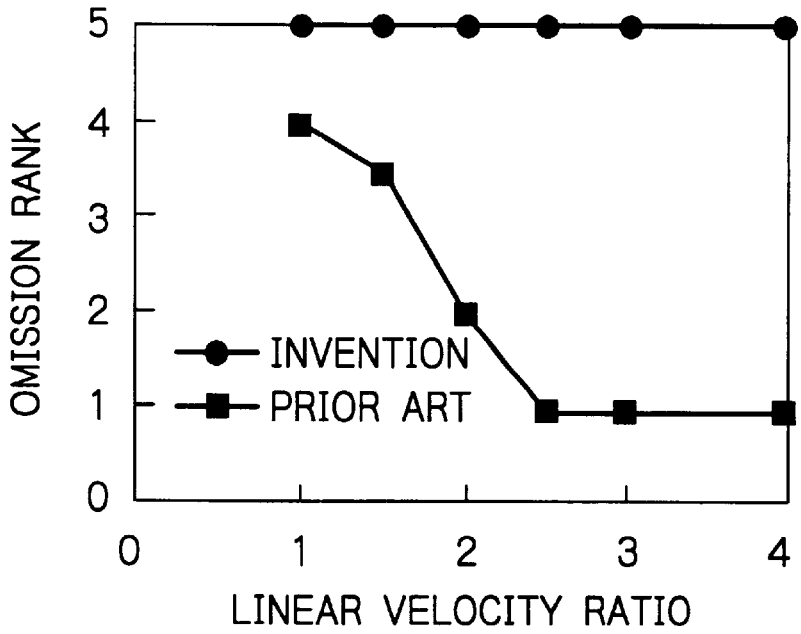
FIG. 19 is a graph showing a relation between the ratio of the linear velocity of a sleeve to that of the photoconductive element and the omission of the trailing edge.

Further, experiments were conducted with the magnet roller of the illustrative embodiment with respect to coefficients even smaller than those shown in FIG. 17. FIG. 18 plots the results of the experiments. As shown, when the coefficient $\mu$ was less than 0.1, the omission rank was desirable for the coefficient $\mu$ of 0.02 or above. It is therefore preferable to apply the lubricant to the drum such that the coefficient $\mu$ is 0.02 or above, but less than 0.7, more preferably 0.6 or below.

Figure 20:
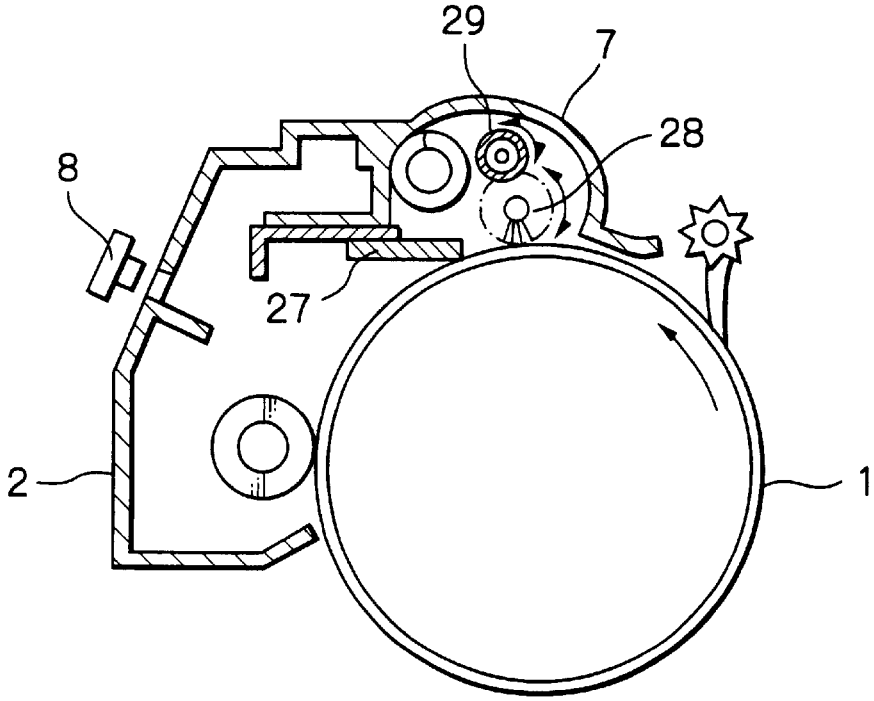
FIG. 20 is a view showing the lubricator disposed in a drum cleaner.

FIG. 20 shows a modification of the illustrative embodiment in which the applicator is disposed in the drum cleaner 7. In FIG. 20, structural elements identical with the structural elements shown in FIG. 1 are designated by identical reference numerals and will not be described specifically in order to avoid redundancy. As shown, the applicator is made up of a brush roller 28 for applying a lubricant to the drum 1 and a lubricant roller or lubricant feeding member 29 for feeding the lubricant to the brush roller 28. Basically, development and image transfer collect the same amount of lubricant from the drum 1 as in the previous configuration. Therefore, to provide the drum 1 with a desired coefficient of friction, a condition in which the lubricator contacts the drum 1 is varied. Specifically, to increase the coefficient of friction, the amount by which the lubricant roller 29 and brush roller 28 or the brush roller 28 and drum 1 bite into each other is reduced. Alternatively, a difference in peripheral speed between the lubricant roller 29 and the brush roller 28 or between the drum 1 and the brush roller 28 may be reduced. To reduce the coefficient of friction, the above amount of bite or the difference in peripheral speed is increased.

The coefficient of friction on the drum 1 must sequentially decrease to preselected one with the elapse of time under a preselected condition. To meet this requirement, the amount of the lubricant left on the drum 1 after image transfer must sequentially increase, so that the amount of application and that of collection become equal to each other when the coefficient of friction is stabilized. The collection of the lubricant from the drum 1 occurs at both of the developing position and image transferring position. Initially, at the developing position, the lubricant is only collected. The lubricant introduced into the developer is again applied to the drum 1 due to the contact of the magnet brush with the drum 1. The amount of the lubricant in the developer sequentially increases with the elapse of time until the amount of collection and the amount of reapplication become equal to each other. As a result, the lubricant is substantially not collected any further at the developing position. It follows that after the coefficient of friction has been stabilized, the lubricant is collected only at the image transferring position and therefore applied and collected in the same amount.

As for the amount of application and that of collection equal to each other, three different patterns may be contemplated, i.e., one in which the amount of application is constant while the amount of collection increases, one in which the amount of collection is constant while the amount of application decreases, and one in which the amount of application decreases while the amount of collection increases. The amount of collection, however, sequentially decreases due to the reapplication at the developing section. Therefore, the case wherein the amount of application is constant while the amount of collection increases and the case wherein the former decreases while the latter increases do not hold. The case wherein the amount of collection is constant while the amount of application decreases actually occurs.

The lubricant applied to the drum 1 serves to reduce the relative coefficient of friction of the drum 1 and that of a blade 27 included in the drum cleaner 7, thereby preventing the blade 27 from shaving the drum 1. This successfully frees the drum 1 and blade 27 from wear and extends the life of the drum 1 and that of the blade 27.

Figure 21:
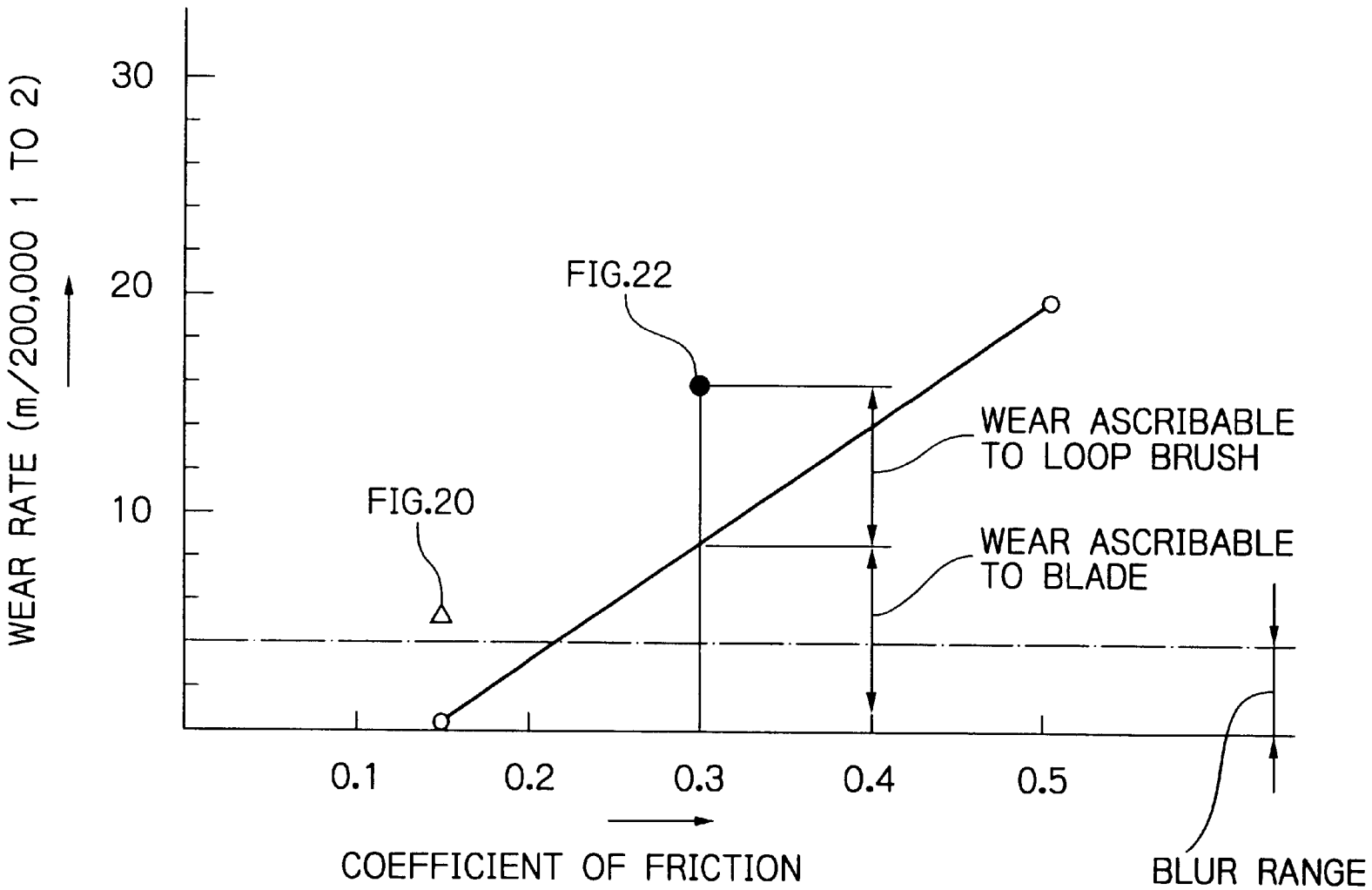
FIG. 21 is a graph showing a relation between the coefficient of friction of the photoconductive element and the wear of the photoconductive element.
Figure 22:
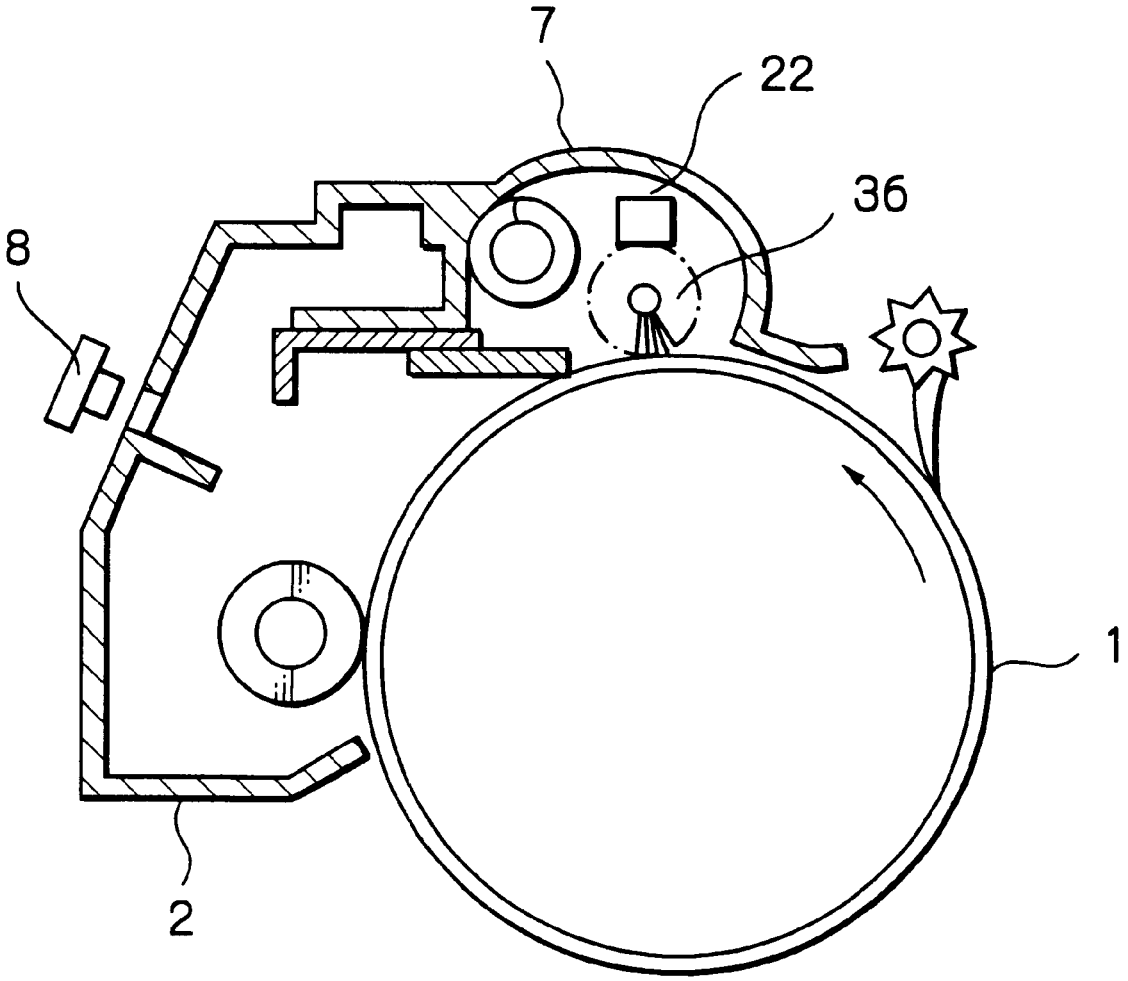
FIG. 22 is a view associated with FIG. 20, showing a lubricant not contacting a lubricant roller, but contacting a loop brush.

As shown in FIG. 21, the wear of the drum 1 decreases with a decrease in the coefficient of friction. Therefore, to extend the life of the drum 1, the coefficient of friction should be as small as possible. As shown in FIG. 22, assume an applicator made up of a loop brush 36 and a stationary, solid lubricant 22. In FIG. 21, a solid line indicates a relation between the coefficient of friction and the wear of the drum 1 determined with the configuration shown in FIG. 22. For experiments, the drum 1 had a diameter of 30 mm. Paper sheets of size A4 were sequentially conveyed at a linear velocity of 114 mm/sec in a landscape one-to-two mode. The loop brush 36 bit into the drum 1 by 1.5 mm.

When the coefficient of friction decreases, the surface of the drum 1 is prevented from being shaved. Assume a wear range indicated by a dash-and-dot line in FIG. 21 in which the amount of wear is 4 $\mu$m or less. Then, in a hot, humid environment, NOx (nitrogen oxides) derived from charging and image transfer accumulate on the surface of the drum 1 and absorbs moisture. As a result, the resistance of the drum surface decreases and obstructs the formation of a latent image, resulting in the blur of an image.

Figure 23:
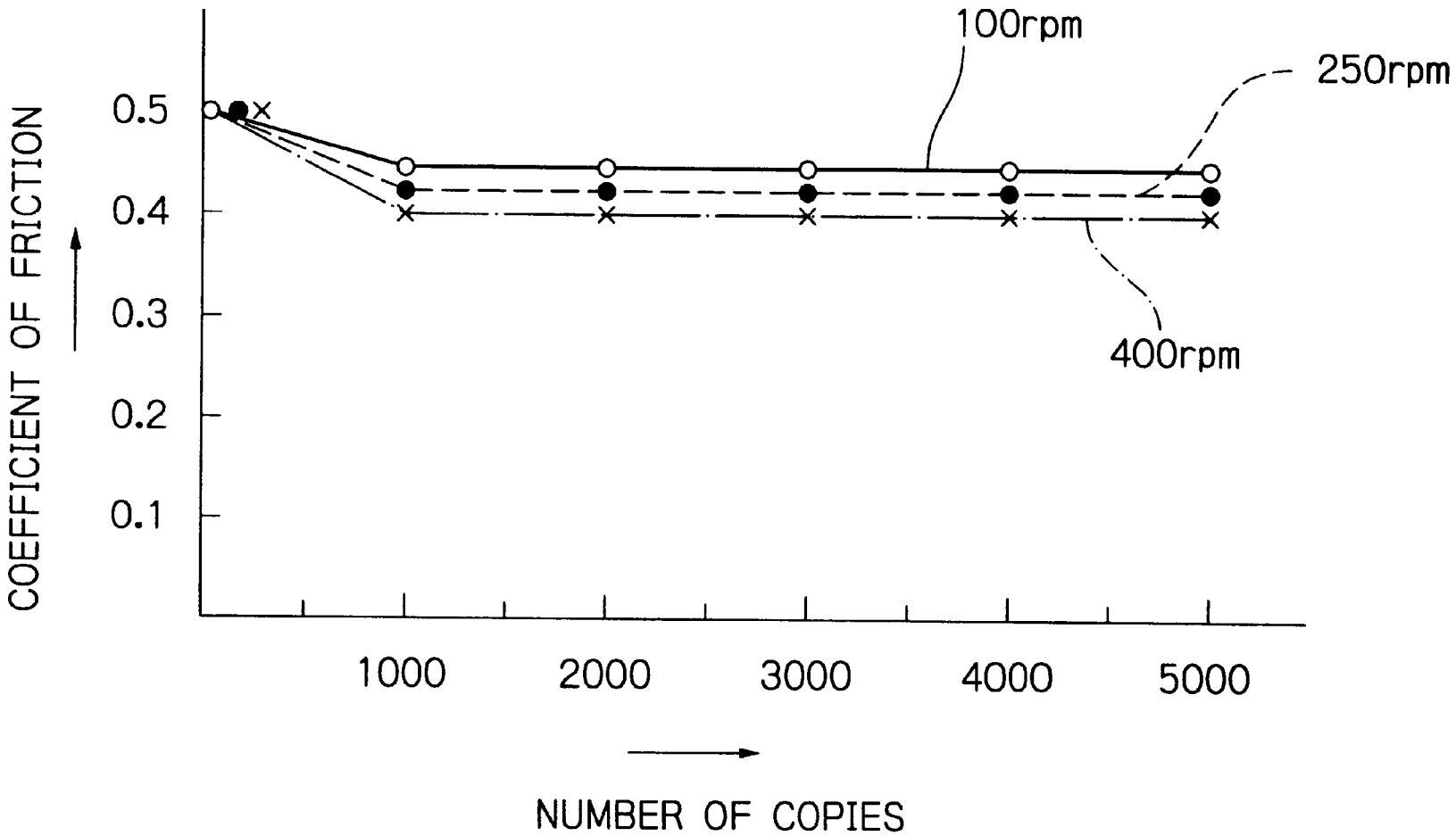
FIG. 23 is a graph showing how the coefficient of friction of the photoconductive element varies along with the number of copies when the loop brush is rotated in the opposite direction to the photoconductive element.
Figure 24:
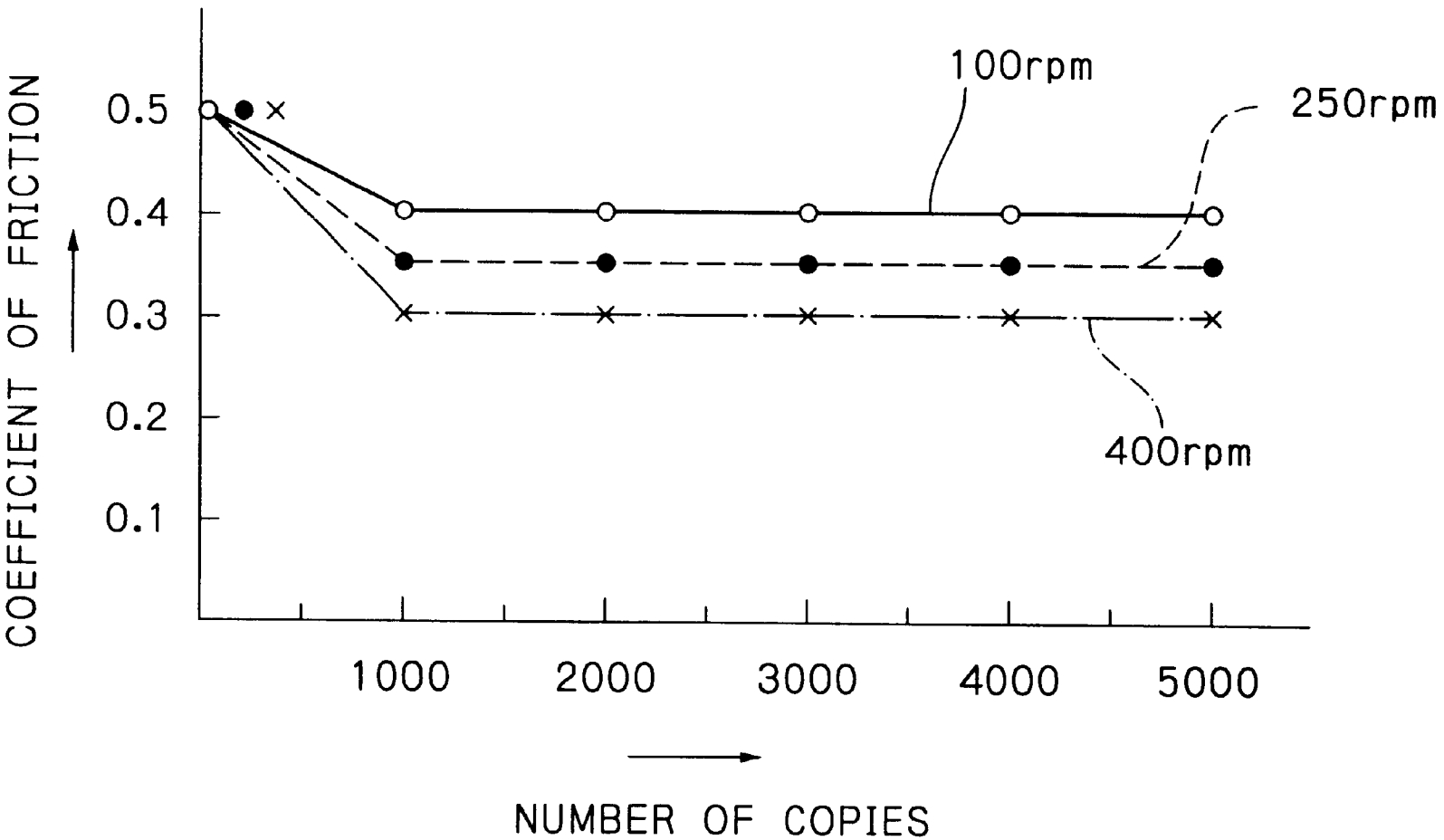
FIG. 24 is a graph similar to FIG. 23, showing the variation of the coefficient of friction to occur when the loop brush is rotated in the same direction as the photoconductive element.

FIG. 23 shows a relation between the coefficient of friction of the drum 1 and the number of copies determined when the loop brush 36, FIG. 22, was rotated in the opposite direction to the drum 1. FIG. 24 shows the same relation as FIG. 23, but determined when the loop brush 36 was rotated in the same direction as the drum 1. As FIGS. 22 and 23 indicate, in the configuration shown in FIG. 22, the coefficient of friction decreases little even when the rotation speed is increased. This is because the loop brush 36 polishes the lubricant deposited on the drum 1.

The loop brush 36 functions to slightly polish the drum 1 and to apply the lubricant to the drum 1 at the same time. FIG. 21 shows the result of image formation repeated over a long term under the following experimental conditions. The loop brush 36 was rotated at a speed of 400 rpm (revolutions per minute). The drum 1 had a diameter of 30 mm. Paper sheets of size A4 were sequentially fed at a linear velocity of 114 mm/sec in the one-to-two landscape mode. The loop brush 36 bit into the drum 1 by 1.5 mm. At a point indicated by a dot in FIG. 21, the drum 1 wears by about 16 $\mu$m. This is because the loop brush 36 and blade 27 both shave the surface of the drum 1. To reduce the wear of the drum 1, a straight brush that does not shave the drum 1 may be used for reducing the coefficient of friction. A straight brush will be described later specifically.

To extend the life of the drum 1 while obviating the blur of an image, an arrangement may be made such that the cleaning blade 27 does not shave the drum 1 at all, but the loop brush 36 shaves it by an amount not causing an image to be blurred. The feed of the lubricant to the loop brush 36 depends on the PV value of the lubricant and loop brush 36; P and V respectively denote the amount of bide, contact width or similar pressure and a difference in peripheral speed. It follows that the coefficient of friction decreases if the difference in peripheral speed between the loop brush 36 and the drum 1 is increased such that the brush 36 feeds the lubricant more than it shaves it off from the drum 1.

Figure 25:
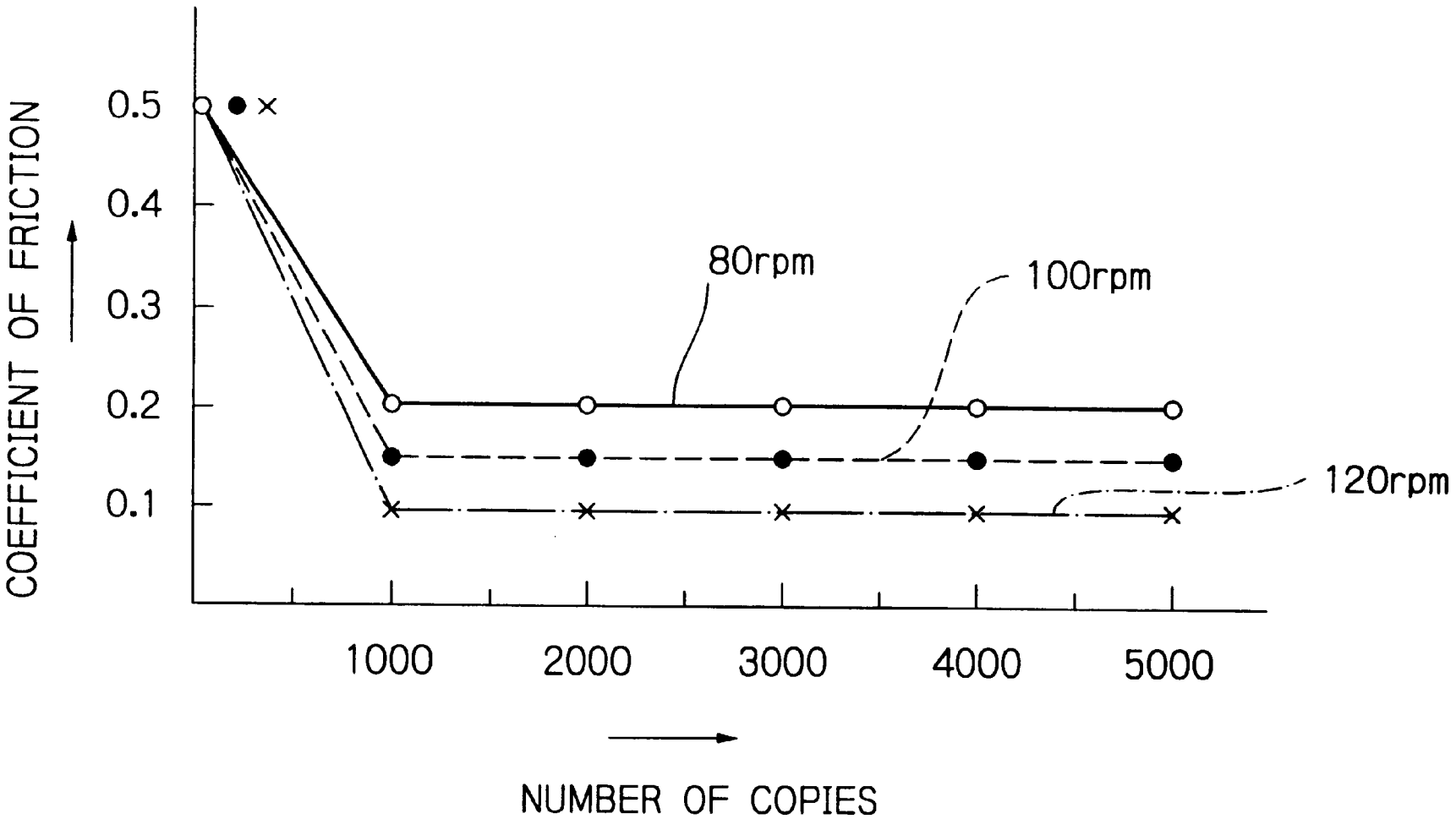
FIG. 25 is a graph showing the variation of the coefficient of friction ascribable to the number of copies and occurring when a ratio in linear velocity between the lubricant roller and a brush roller is 2 and when the directions of rotations are opposite.
Figure 26:
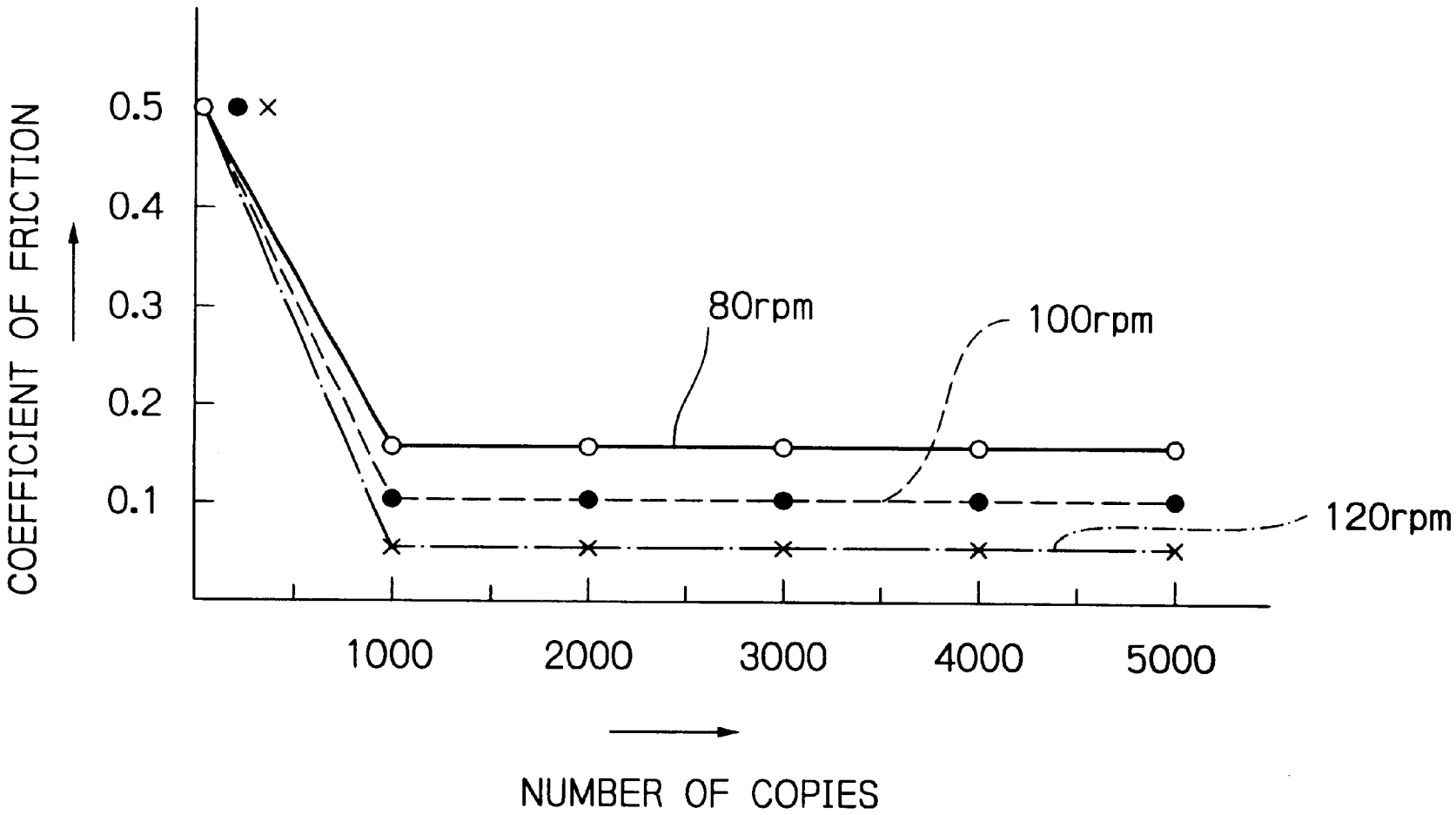
FIG. 26 is a view similar to FIG. 25, showing the variation of the coefficient of friction occurring when the directions of rotations are the same.
Figure 27:
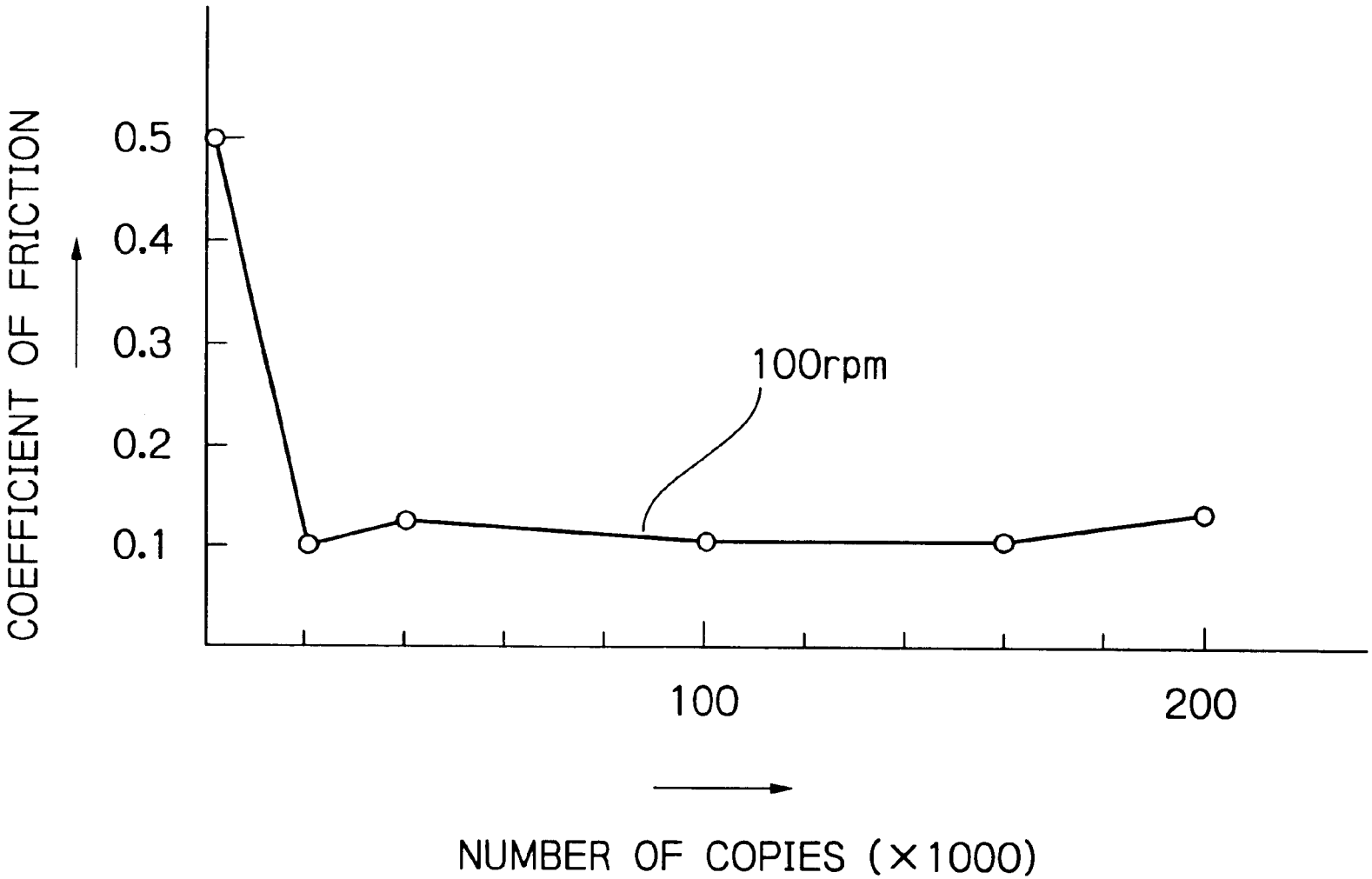
FIG. 27 is a graph showing the variation of the coefficient of friction occurring over a long term of image formation effected at a rotation speed of 100 rpm (revolutions per minute) shown in FIG. 26.

FIG. 25 shows a relation between the number of copies and the coefficient of friction determined with respect to some different rotation speeds. In this case, the lubricator 29 had a diameter of 10 mm. The ratio of the linear velocity of the lubricant roller 29 to that of the brush roller 28 was doubled. The loop brush 36 was rotated in the opposite direction to the drum 1. FIG. 26 shows the same relation as FIG. 25, but determined when the loop brush 36 was rotated in the same direction as the drum 1. Further, FIG. 27 shows how the coefficient of friction varied when image formation was repeated over a long period of time at the rotation speed of 100 rpm shown in FIG. 26. As shown, the coefficient of friction varies over a width of about 0.1 to 0.15. In this condition, the drum 1 wore by about 5 $\mu$m and protected images from blur even when 200,000 paper sheets of size A4 were sequentially fed in the one-to-two landscape mode at a linear velocity of 114 mm/sec. The drum 1 had a diameter of 30 mm.

Figure 28:
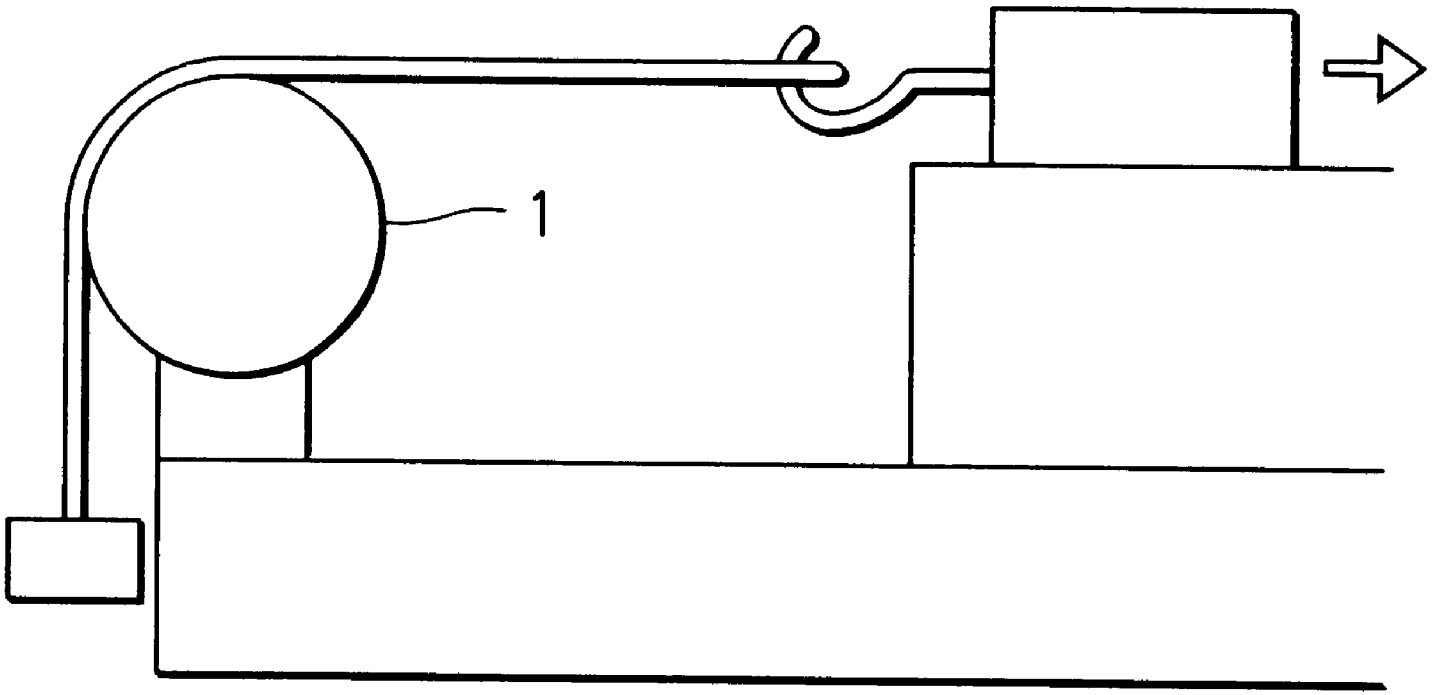
FIG. 28 is a view showing a specific arrangement for measuring the coefficient of friction of the photoconductive element by an Euler's belt system.

FIG. 28 shows a specific arrangement for measuring the coefficient of friction of the drum 1. The arrangement is used to measure and calculate a coefficient of friction by a so-called Euler belt system described in "Mechanical Engineering Handbook," The Japan Society of Mechanical Engineers, Fundamentals, A3 Dynamics and Mechanical Dynamics, 1986, page 35. For measurement, a 100 g weight was used. The coefficient $\mu$ was produced by $1n(F/100)/(\pi/2))$.

Figure 29:
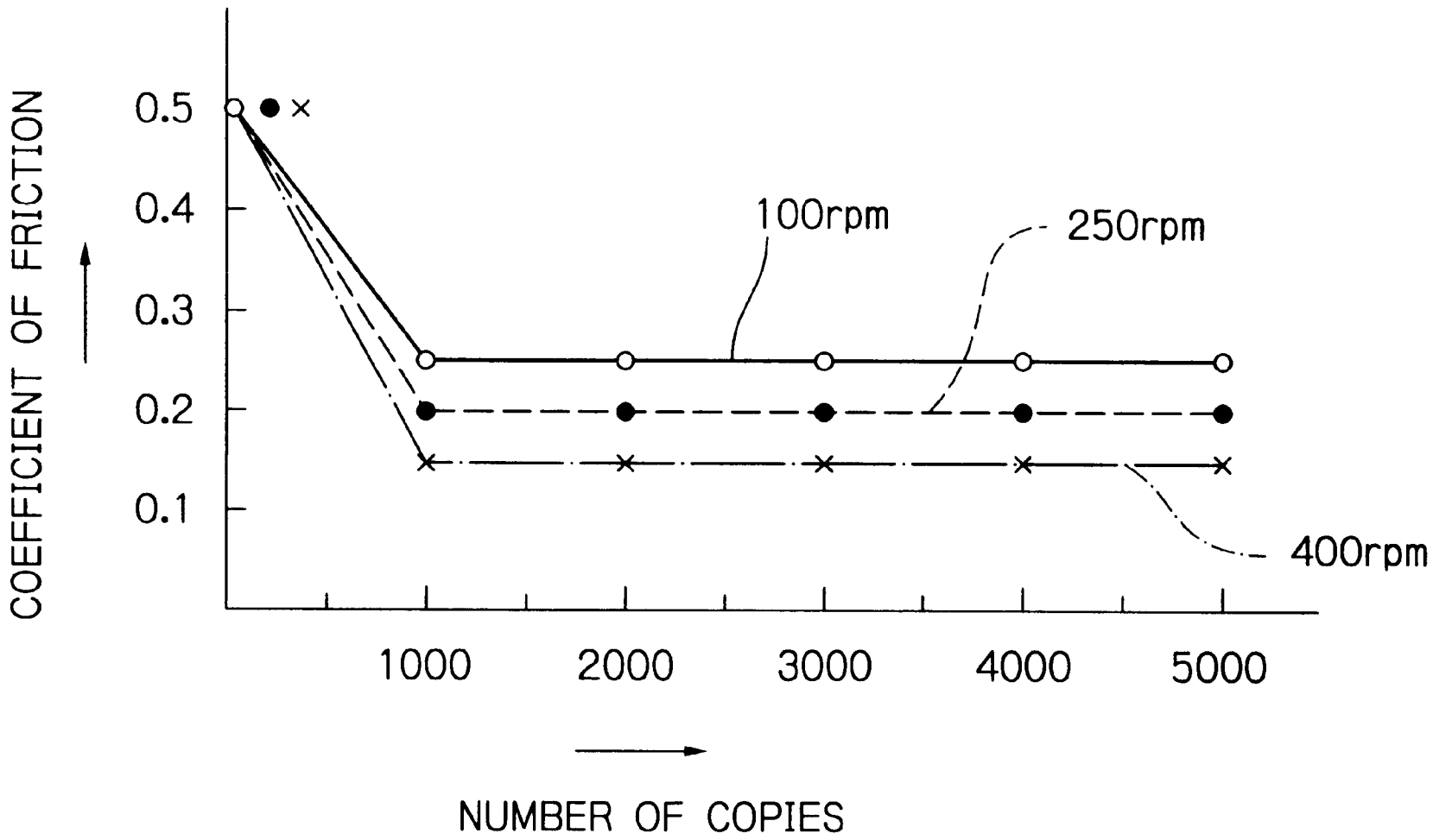
FIG. 29 is a graph showing the variation of the coefficient of friction of the photoconductive element ascribable to the variation of the number of copies and occurring when a straight brush is substituted for a loop brush and when the brush is rotated in the opposite direction to the photoconductive element.
Figure 30:
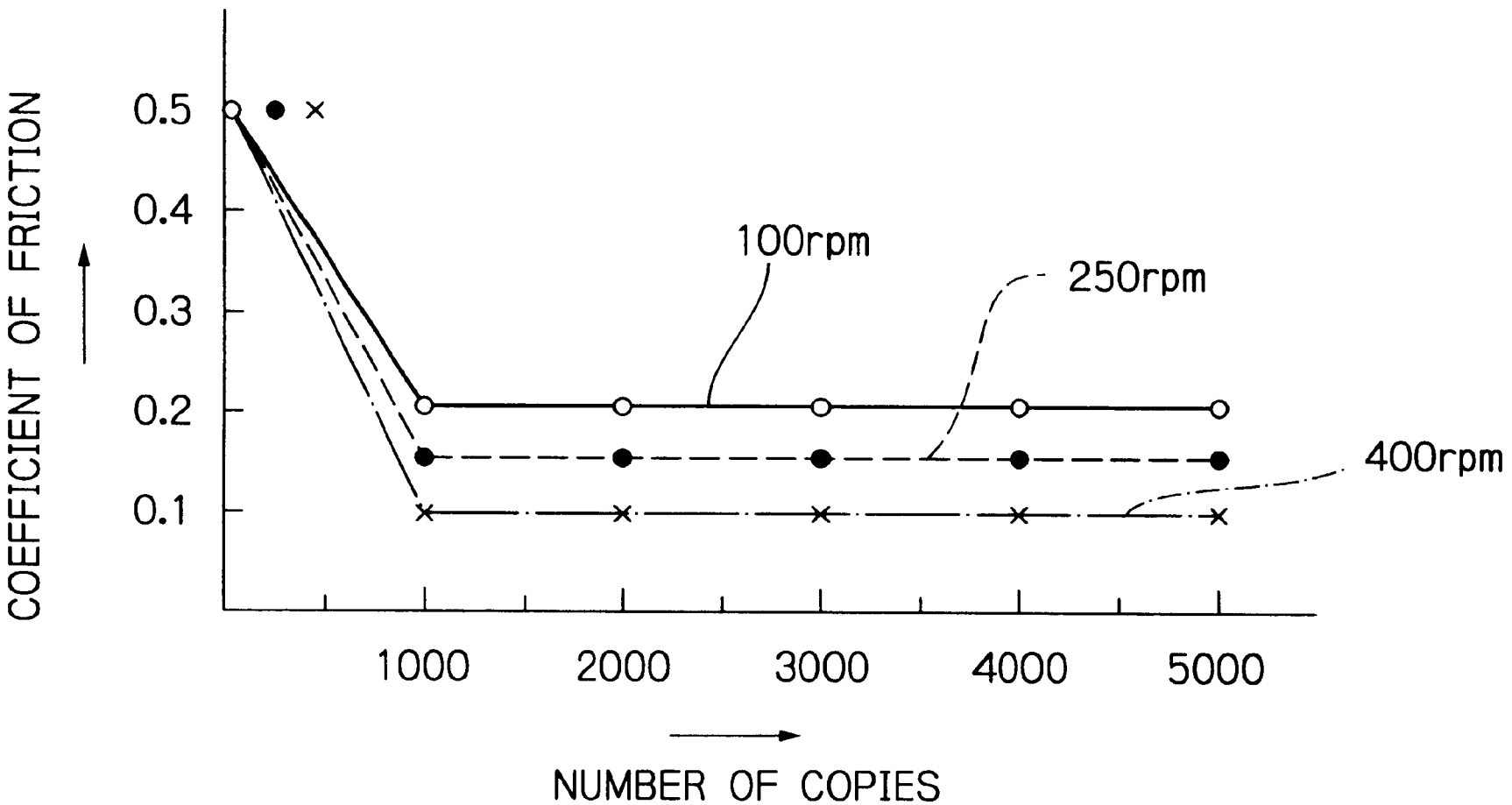
FIG. 30 is a graph similar to FIG. 29, showing the variation of the coefficient of friction occurring when the brush is rotated in the same direction as the photoconductive element.

A straight brush having a diameter of 15 mm was substituted for the loop brush 36 shown in FIG. 22 and caused to bite into the drum 1 by 1.5 mm. FIG. 29 shows a relation between the number of copies and the coefficient of friction of the drum 1 determined when the straight brush was rotated in the opposite direction to the drum 1. FIG. 30 shows the same relation as FIG. 29, but determined when the straight brush was rotated in the same direction as the drum 1. As shown, while the coefficient of friction is dependent on the rotation speed of the straight brush, it noticeably varies in a long term, as shown in FIG. 31.

Figure 31:
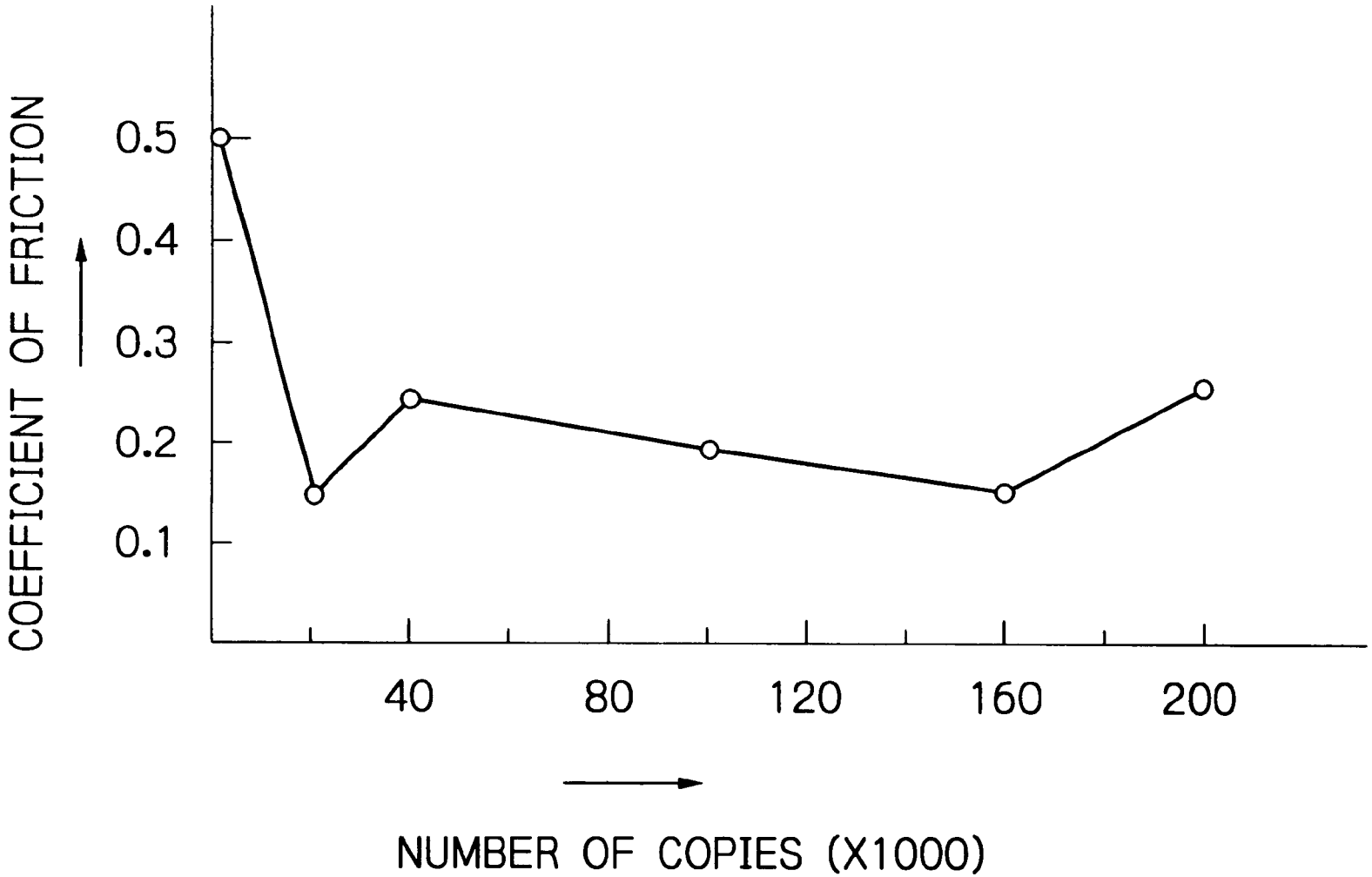
FIG. 31 is a graph showing the variation of the coefficient of friction over a long term.

Specifically, FIG. 31 shows the long-term variation of the coefficient of friction determined when the straight brush had a diameter of 15 mm, rotated at a speed of 400 rpm in the same direction as the drum 1, and bit into the drum 1 by 1.5 mm. As shown, the coefficient of friction varies between 0.15 and 0.25, i.e., by about ±0.05. Even when the coefficient of friction is so controlled as not to protect images from blur, it lies in the range of from 0.25 to 0.35. If the coefficient of friction settles at the maximum value of 0.35, then the wear of the drum 1 amounts to about 12 $\mu$m when 200,000 copies are produced.

Figure 32:
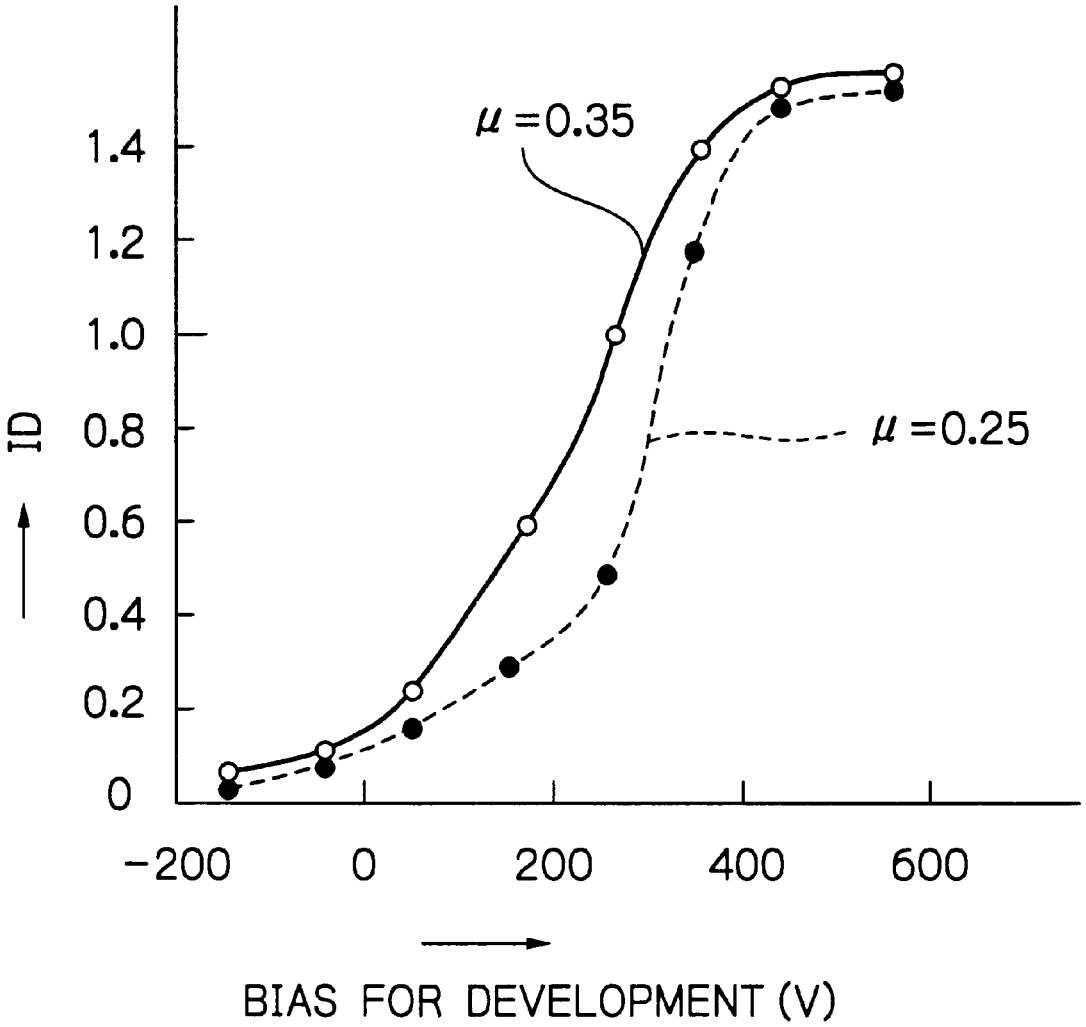
FIG. 32 is a graph showing a relation between a bias for development and image density with respect to different coefficients of friction.

When the lubricant is absent, the drum 1 having a diameter of 30 mm has a coefficient of friction of about 0.5 and wears by about 20 $\mu$m for 20,000 copies. Therefore, the effect achievable is about 40%, but not sufficient. Of course, if the coefficient of friction varies between 0.25 and 0.35 due to aging, then the amount of wear will further decrease. However, as shown in FIG. 32, the amount of toner to deposit on the drum 1 and therefore image density varies along with the coefficient of friction. As shown in FIG. 21, a small coefficient of friction translates into a small amount of wear. However, when the coefficient of friction is ultimately reduced to 0.15 or below and caused to vary little, images are blurred because the cleaning blade 27 does not polish the drum 1. The contact condition should therefore be so selected as to implement a coefficient of friction that allows the drum 1 to wear by 4 $\mu$m or more.

Figure 33:
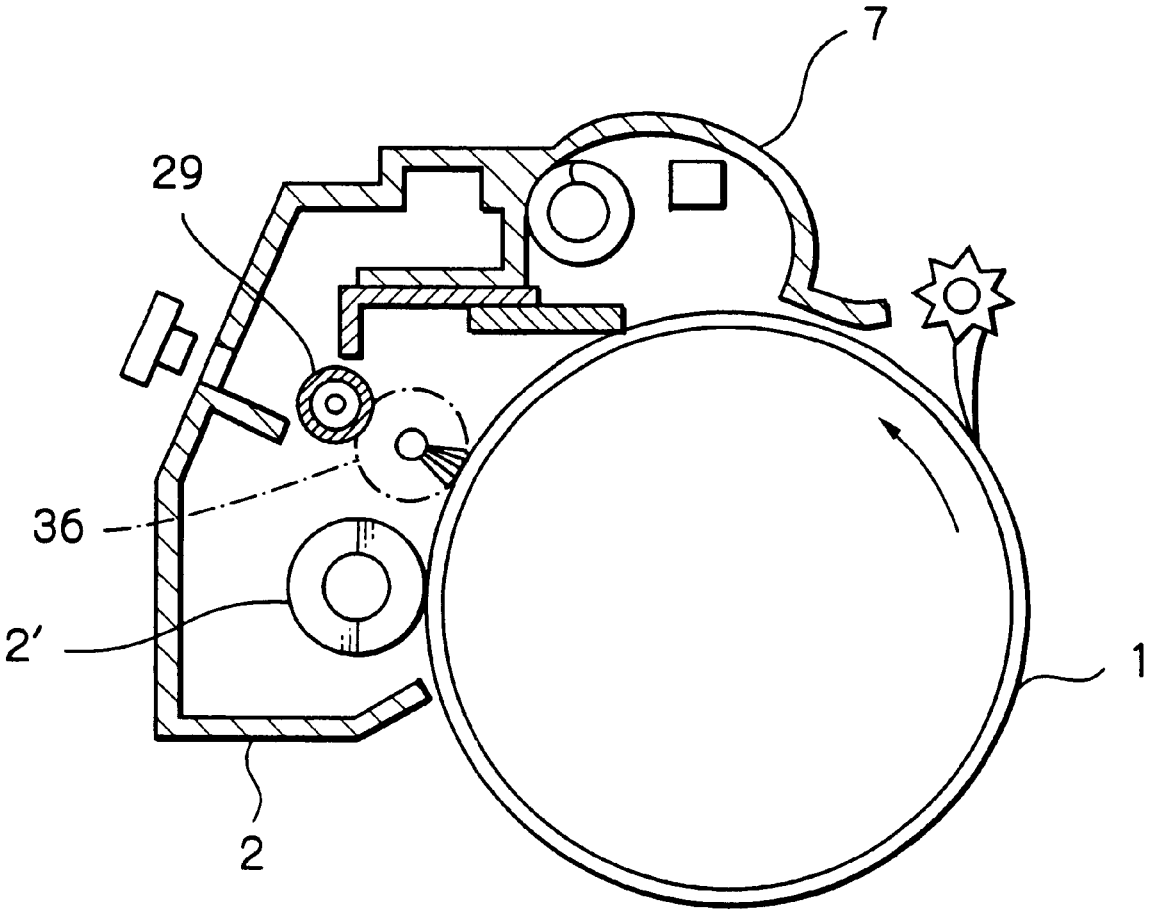
FIG. 33 is a view showing the lubricator positioned upstream of a charge roller in the direction of rotation of the photoconductive element.
Figure 34:
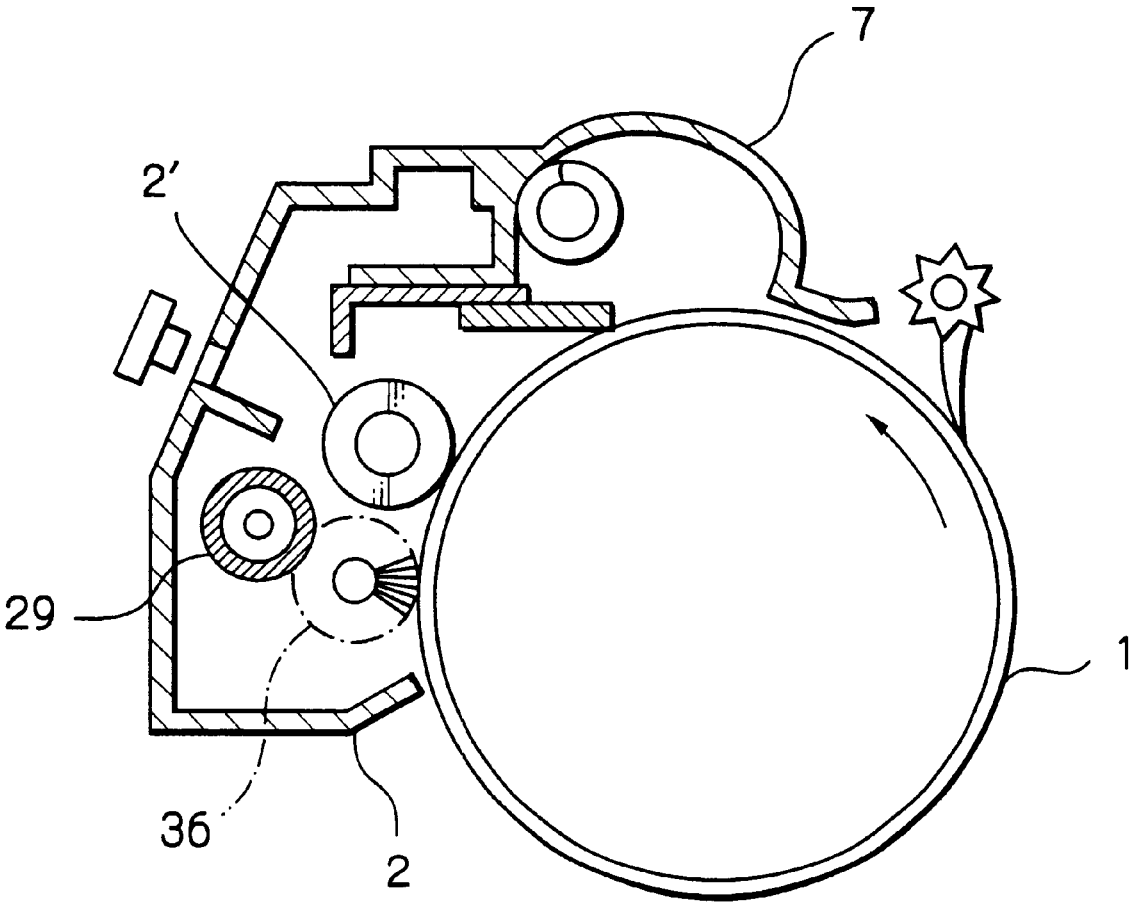
FIG. 34 is a view showing the lubricator positioned downstream of the charge roller.

FIGS. 33 and 34 each show a specific configuration in which the lubricator made up of the brush roller 26 and lubricant roller or lubricant feeding member 29 is arranged in the charger 2. In FIGS. 33 and 34, structural elements identical with FIG. 20 are designated by identical reference numerals and will not be described specifically in order to avoid redundancy. The configurations shown in FIGS. 33 and 34 are free from the adverse influence of toner left on the drum 1 after image transfer and therefore protect the coefficient of friction from irregularity.

As stated above, in the illustrative embodiment, the surface of the image carrier has a coefficient of friction of 0.5 or below. Such a coefficient of friction enhances efficient image transfer, reduces residual toner, and promotes easy cleaning in the developing section. Further, even in an image forming apparatus capable of obviating vermiculation in the portion of the image carrier where much toner is deposited, the illustrative embodiment provides a halftone image with uniformity, prevents the trailing edge of an image from being lost, and faithfully reproduces even a horizontal line.

Moreover, in the illustrative embodiment, a difference in linear velocity between the brush roller of the lubricator and the lubricant feeding member is greater than a difference in linear velocity between the image carrier and the brush roller. In this condition, the brush roller slightly polishes the surface of the image carrier to thereby remove NOx generated by charge and image transfer and buried in the lubricant on the image carrier.

Figure 35:
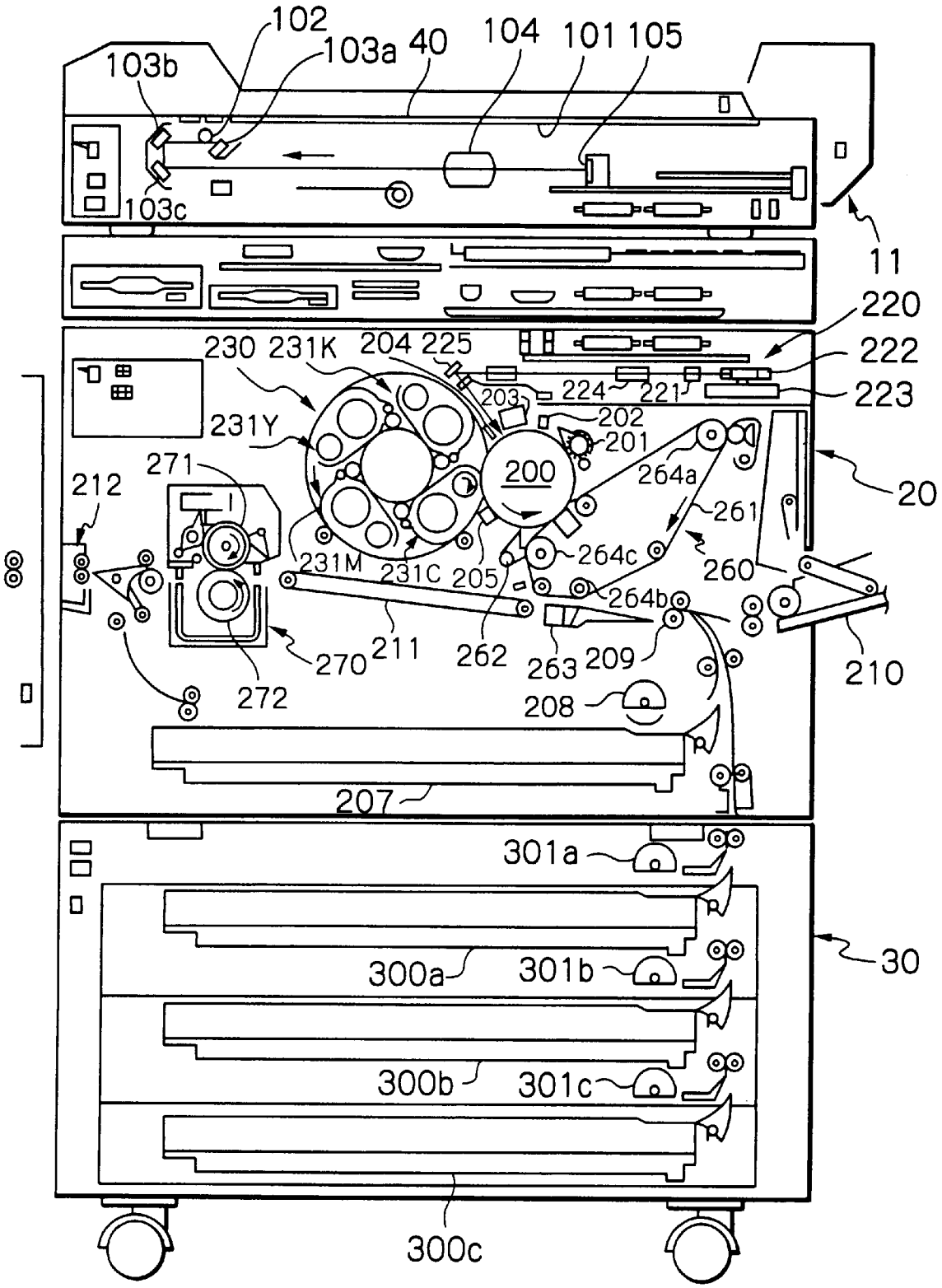
FIG. 35 is a view showing an alternative embodiment of the present invention.

Referring to FIG. 35, an alternative embodiment of the present invention will be described which is implemented as an electrophotographic color copier by way of example. As shown, the color copier includes a color scanner or document reading device 11, a color printer or color image recording device 20, a sheet bank 30, and a controller to be described specifically later.

The color scanner 11 includes a lamp 102 for illuminating a document 40 laid on a glass platen 101. The resulting imagewise reflection from the document 40 is routed through a group of mirrors 103*a*, 103*b* and 103*c* and a lens 104 to a color sensor 105. The color sensor 105 reads color image information representative of the document 40 color by color to thereby output, e.g., R (red), G (green) and B (blue) electric color signals. In the illustrative embodiment, the color sensor 105 reads R, G and B color images derived from the image of the document 40 at the same time. An image processing section, not shown, converts the R, G and B color signals to Bk (black), C (cyan), M (magenta) and Y (yellow) color image data on the basis of the intensity levels of the R, G and B signals.

More specifically, to produce the Bk, C, M and Y color image data, optics including the lamp 102 and mirrors 103*a*–103*c* scans the document 40 in a direction indicated by an arrow in FIG. 1 in response to a scanner start signal synchronous to the operation of the color printer 20 which will be described later. The optics repeatedly scans the same document 40 four consecutive times in order to sequentially output color image data of four different colors. Every time the color printer 12 receives the color image data of one color, it produces a corresponding toner image. Finally, four toner images are superposed to complete a four-color or full-color image.

The color printer 20 includes a photoconductive drum or image carrier 200, an optical writing unit 220, a revolver or rotary developing device 230, an intermediate image transferring device 260, and a fixing device 270. The drum 200 is rotatable counterclockwise, as indicated by an arrow in FIG. 35. Arranged around the drum 200 are a drum cleaner 201, a discharge lamp 202, a charger 203, a potential sensor or potential sensing means 204, one of four developing sections included in the revolver 230, a density pattern sensor 205, and a belt 261 included in the intermediate image transferring device 260. The revolver 230 has four developing sections, i.e., a Bk developing section 231K, an M developing section 231M, a C developing section 231C, and a Y developing section 231Y. In FIG. 35, the C developing section 231C is shown as facing the drum 200.

The optical writing unit 220 converts the color image data received from the scanner 11 to an optical signal and writes an image represented by the image data on the drum 200 with the optical signal, thereby electrostatically forming a latent image on the drum 200. For this purpose, the writing unit 220 includes a semiconductor laser 221, a laser drive controller, not shown, a polygonal mirror 222, a motor 223 for driving the mirror 222, an f/θ lens 224, and a mirror 225.

The revolver 230 including the four developing sections 231K, 231C, 231M and 231Y is bodily rotated by a driveline that will be described later. The developing sections 231K–231Y each include a developing sleeve rotatable with the head of a developer deposited thereon contacting the surface of the drum 200, and a paddle for scooping up and agitating the developer. The developer stored in each developing section is a mixture of toner of particular color and ferrite carrier. While the developer is agitated, the toner is charged to negative polarity due to friction acting between it and the carrier. A particular bias power source, not shown, is assigned to each developing sleeve and applies a bias for development to the sleeve, so that the sleeve is biased to a preselected potential relative to the metallic base of the drum 200. The bias is a negative DC voltage Vdc on which an AC voltage Vac is superposed.

While the copier is in a stand-by state, the revolver 230 is held stationary with its Bk developing section 231K facing the drum 200 at a preselected developing position. On the start of a copying operation, the color scanner 11 starts reading the document 40 at a preselected timing. Optical writing using a laser beam and the formation of a latent image begin on the basis of the resulting color image data. Let a latent image derived from Bk image data be referred to as a Bk latent image. This is also true with C, M and Y. To develop the Bk latent image from its leading edge, the Bk sleeve starts rotating before the leading edge of the Bk latent image arrives at the developing position. The Bk sleeve develops the Bk latent image with Bk toner. As soon as the trailing edge of the Bk latent image moves away from the developing position, the revolver 230 bodily rotates to bring the next developing section to the developing position. This rotation is completed at least before the leading edge of the next latent image arrives at the developing position. The construction and operation of the revolver 230 will be described more specifically later.

The intermediate image transferring device 260 includes the intermediate transfer belt 261, a belt cleaning device 262, and a corona discharger 263 for paper transfer. The belt 261 is passed over a drive roller 264*a*, a transfer counter roller 264*b*, a cleaning counter roller 264*c* and driven rollers (no numeral) and driven by a motor not shown. The belt 261 is formed of ETFE and has a surface resistance ranging from $10^8$ to $10^{10}$ Ω/cm$^2$. The belt cleaning device 262 includes an inlet seal, a rubber blade, an outlet coil, and a mechanism for moving the inlet seal and rubber blade into and out of contact with the belt 261. While the transfer of images of the second, third and fourth colors to the belt 261 is under way after the transfer of the Bk or first-color image, the above mechanism maintains the inlet seal and blade released from the belt 261. The corona discharger 263 is applied with an AC-biased DC voltage or a DC voltage in order to transfer the entire full-color image from the belt 261 to a paper or similar recording medium.

The color printer 20 includes a paper cassette 207 while the sheet bank 30 includes paper cassettes 300*a*, 300*b* and 300*c*. The paper cassettes 207 and 300*a* through 300*c* each are loaded with a stack of paper sheets 6 of particular size. A pickup rollers 208 and pickup rollers 301*a* through 301*c* are respectively assigned to the paper cassettes 207 and 300*a* through 300*c*. Paper sheets are fed from desired one of the cassettes 207 and 300*a* through 300*c* by associated one of the pickup rollers 301*a* through 301*c* toward a registration roller pair 209. A manual feed tray 210 is mounted on the right side of the printer 120, as viewed in FIG. 35, for allowing the operator to feed OHP (OverHead Projector) sheets, thick sheets or similar special sheets by hand.

In operation, at the beginning of an image forming cycle, the drum 200 and belt 261 are caused to rotate counterclockwise and clockwise, respectively. Bk, C, M and Y toner image are sequentially formed on the drum 200 and sequentially transferred from the drum 200 to the belt 261 one above the other, completing a full-color image on the belt 261.

Specifically, to form the Bk toner image, the charger 203 uniformly charges the drum 200 to about −700 V. The semiconductor laser 221 scans the charged drum 200 in accordance with the Bk color image signal by raster scanning. In the portions of the drum 200 exposed by the laser 221, the charge is lost by an amount proportional to the quantity of light with the result that the Bk latent image is formed. Negatively charged Bk toner deposited on the Bk developing sleeve contacts the Bk latent image and deposits only on the exposed portions of the drum 200 where the charge has been lost. Consequently, a Bk toner image corresponding to the latent image is formed on the drum 200. The corona discharger 265 transfers the Bk toner image from the drum 20 to the belt 261 moving at the same speed as the drum 200 in contact with the drum 200. The transfer of a toner image from the drum 200 to the belt 261 will be referred to as belt transfer hereinafter.

After the belt transfer, the drum cleaner 201 removes the toner left on the drum 200 in a small amount, thereby preparing the drum 200 for the next image forming cycle. The toner removed by the drum cleaner 201 is collected in a waste toner tank via a piping although not shown specifically.

A C image forming step begins with the drum 200 after the above Bk image forming step. Specifically, the color scanner 11 starts reading C image data at a preselected timing. Laser writing using the resulting C image data forms a C latent image on the drum 200. After the trailing edge of the Bk latent image has moved away from the developing position, but before the leading edge of the C latent image arrives at the developing position, the revolver 230 is caused to rotate to bring the C developing unit 231C to the developing position. The C developing section 231C then develops the C latent image with C toner. As soon as the trailing edge of the C latent image moves away from the developing position, the revolver 230 is again rotated to bring the M developing section 231M to the developing position. This is also completed before the leading edge of the M latent image arrives at the developing position.

Because M and Y developing steps are similar to the Bk and C steps as to color image data reading, latent image formation and development will not be described specifically in order to avoid redundancy.

The Bk, C, M and Y toner images are sequentially transferred from the drum 200 to the belt 261 one above the other so as to form a full-color image on the belt 261. Subsequently, the corona discharger 263 transfers the entire full-color image from the belt 261 to a paper sheet.

The paper sheet 6 is fed from any one of the previously stated paper cassettes or the manual feed tray and stopped by the registration roller pair 209. Thereafter, the registration roller pair 209 conveys the paper sheet 6 such that the leading edge of the paper sheet 6 meets the leading edge of the toner image carried on the belt 261 and reaching the corona discharger 263. The paper sheet 6 moves above the corona discharger 263 while being superposed on the toner image of the belt 261. At this instant, the corona discharger 263 charges the paper sheet 6 with a positive charge with the result that the full-color image is substantially entirely transferred to the paper sheet 6. Subsequently, a corona discharger, not shown, located at the left-hand side of the corona discharger 263 and applied with an AC-biased DC voltage discharges the paper sheet 6. As a result, the paper sheet 6 is separated from the belt 261 and transferred to a belt conveyor 211.

The belt conveyor 211 conveys the paper sheet 6 carrying the full-color image thereon to the fixing device 270 including a heat roller 271 controlled to a preselected temperature and a press roller 272. The heat roller 271 and press roller 272 pressed against the heat roller 271 fix the toner image on the paper sheet 6 with heat and pressure. Thereafter, the paper sheet or full-color copy is driven out of the copier body to a copy tray, not shown, face up by an outlet roller pair 212.

After the belt transfer, the brush roller and rubber blade included in the drum cleaning device 201 clean the surface of the drum 200. The discharge lamp 202 uniformly discharges the cleaned surface of the drum 200. Also, the blade included in the belt cleaning device 262 is again pressed against the belt 261 in order to clean the surface of the belt 261 after the image transfer to the paper.

The revolver 230 will be described more specifically with reference to FIGS. 36 and 37. As shown in FIG. 37, the revolver 230 includes a hollow stay 282 having a rectangular cross-section and extending between a front and a rear, disk-like end plate 230*a* and 230*b*. The developing sections 231K through 231Y are supported by the stay 242 and respectively include casings 283K, 283C, 283M and 283Y identical in configuration with each other. The casings 283K through 283Y each store a developer of particular color, i.e., a mixture toner of particular color and carrier. The revolver 230 is shown as locating the Bk developing section 231K at the developing position and having the Bk developing section 231K, Y developing section 231Y, M developing section 231M and C developing section 231C sequentially arranged in this order in the counterclockwise direction, as viewed in FIG. 36.

Figure 36:
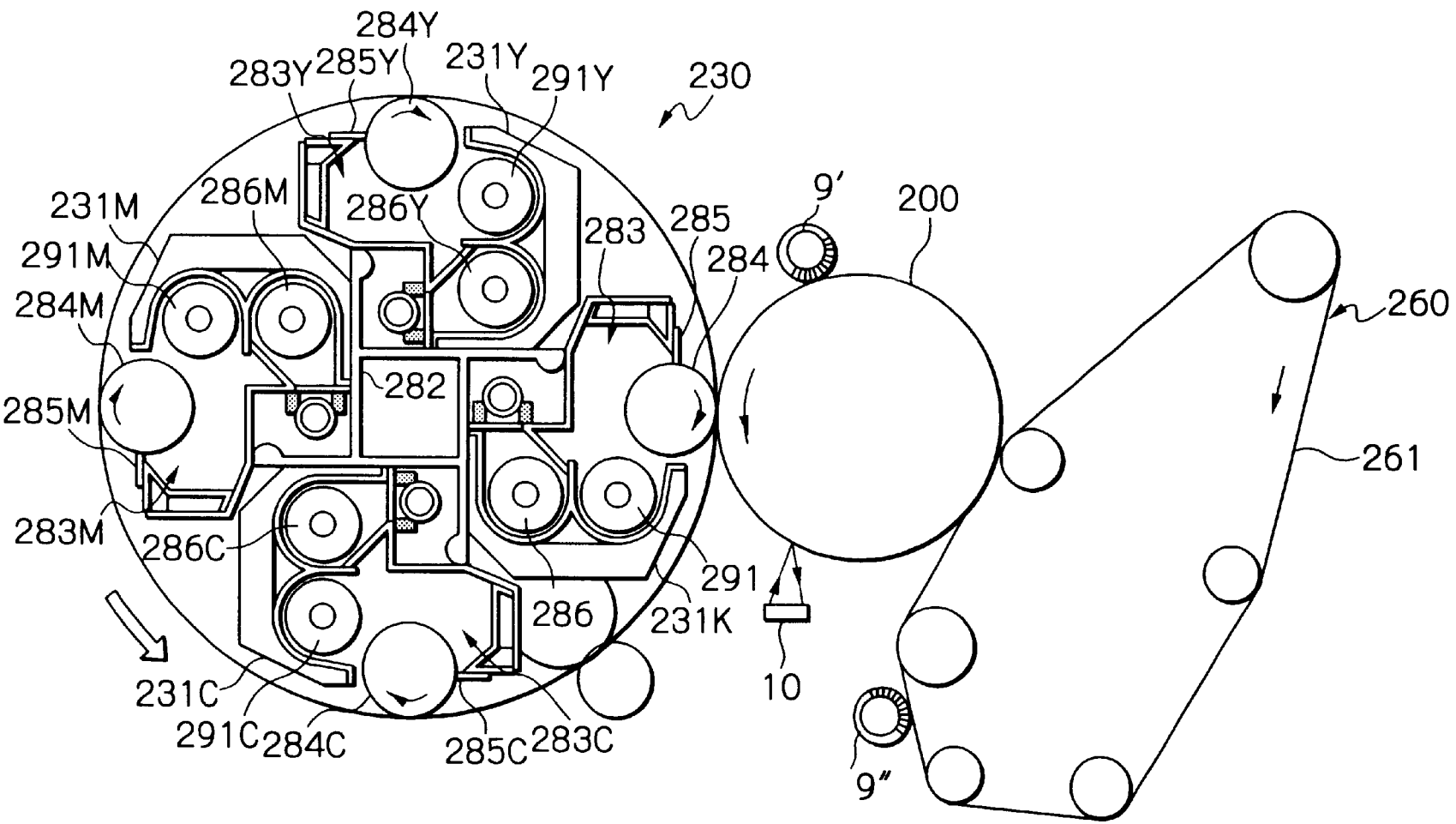
FIG. 36 is a view showing the configuration of a revolver included in the alternative embodiment.
Figure 37:
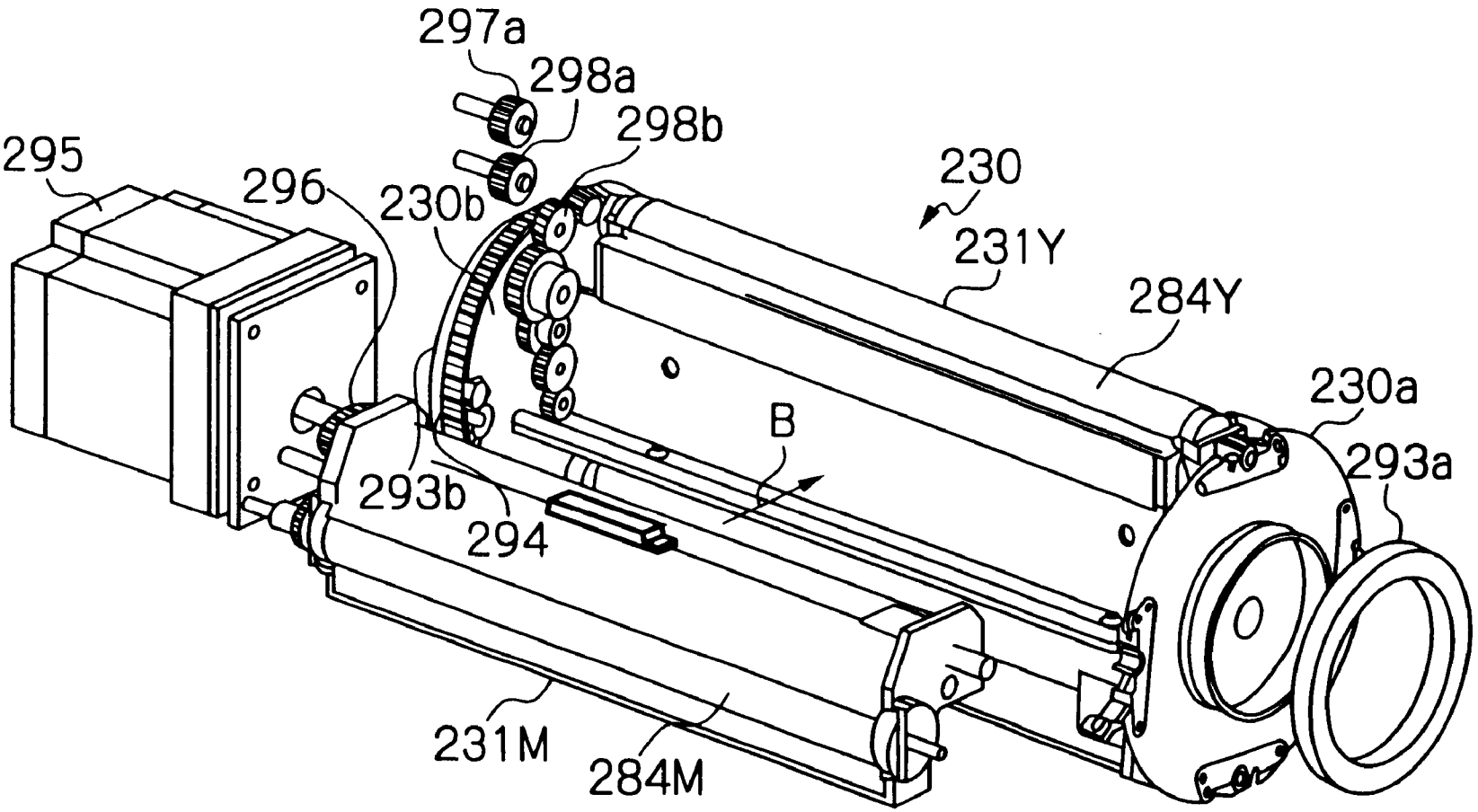
FIG. 37 is an isometric view showing the revolver.

Because the four developing sections 231K through 231C are identical in construction, the following description to be made with reference to FIG. 36 will concentrate on the Bk developing section 231K by way of example. The other developing sections are simply distinguished from the Bk developing section 231K by suffixes Y, M and C.

As shown in FIG. 36, a developing roller or developer carrier 284 adjoins the drum or image carrier 200 via an opening formed in the casing 283 and forms a developing position between it and the drum 20. The developing roller 284 includes a sleeve accommodating a magnet roller thereinside. A doctor blade 285 is also disposed in the casing 283K for regulating the amount of the developer to be conveyed by the developing roller 284 toward the drum 200. A first screw 286 conveys part of the developer scraped off by the doctor blade 285 from the rear to the front in the axial direction. A second screw 289 is identical with the first screw 288 except that it conveys the above part of the developer from the front to the rear. A toner content sensor 292 is positioned in the casing 283K below the second screw 291 for sensing the toner content of the developer stored in the casing 283K.

Figure 38:
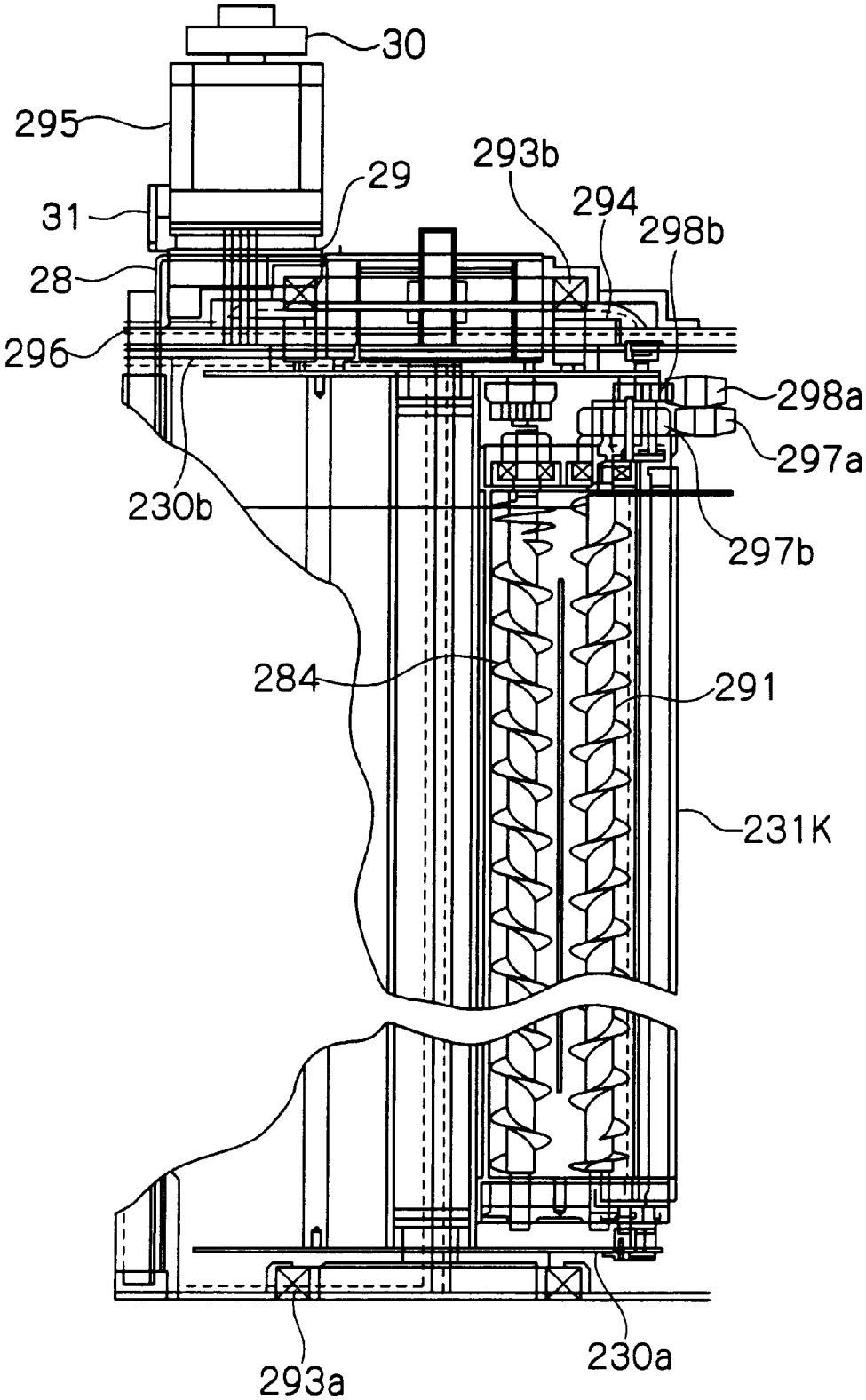
FIG. 38 is a partly taken away section showing the internal arrangement of the revolver.

FIG. 38 is a section in a plan containing the axes of the screws 286 and 291 included in the black developing section 231K. As shown, the screws 286 and 291 each rotating in a particular direction circulate the developer in the casing 283 while agitating it. The developer is then deposited on the sleeve of the developing roller 284 in rotation. The sleeve conveys the developer to the developing position while the doctor blade 285 causes the developer to form a thin layer. At the developing position, toner container in the developer is fed from the sleeve to the drum 200.

As shown in FIGS. 37 and 38, the front and rear end plates 230*a* and 230*b* support bearings 293*a* and 293*b*, respectively. The bearings 293*a* and 293*b* rotatably support the revolver 230. A motor gear 296 is mounted on the output shaft of the revolver motor 295. The revolver motor 295 drives the revolver gear 294 via the motor gear 296, so that one of the developing sections 231K through 231C is located at the developing position. In this position, a development drive gear 297*a* and a toner replenishment drive gear 298*a* are respectively brought into mesh with idler gears 297*b* and 298*b*. This allows development and toner replenishment to be effected, as needed.

The developing roller 284 of each developing section 231 includes auxiliary magnets, not shown, for adjusting the half-width of a main magnet, as in the previous embodiment. As shown in FIG. 36, the illustrative embodiment additionally includes a lubricator 9' for applying a lubricant to the drum 200. The lubricator 9' functions in the same manner as the lubricator 9 of the previous embodiment.

Further, as shown in FIG. 36, the illustrative embodiment includes a lubricator 9" for applying a lubricant to the belt 261 for primary image transfer. Because the belt 261 contacts the drum 200 while forming a nip, the same lubricant should preferably be assigned to both of the lubricators 9' and 9". The pressure of the lubricator 9" acting on the belt 261 or the linear velocity of the lubricator 9" is also variable to vary the amount of the lubricant to be applied to the belt 261. As for the pressure, the lubricant is not applied to the belt 261 when the pressure is zero. The lubricator has a brush implemented by conductive, acrylic fibers.

The lubricant applied to the belt 261 reduces the frictional force of the drum 200 and that of the belt 261 and thereby remarkably extends the life of the drum 200 and that of the belt 261. Moreover, the lubricant obviates toner filming on the belt 261. This successfully reduces, after the primary image transfer, the surface energy of the primary transfer at the time of the secondary image transfer and therefore improves transferability. Images are therefore free from local omission despite aging.

Figure 39:
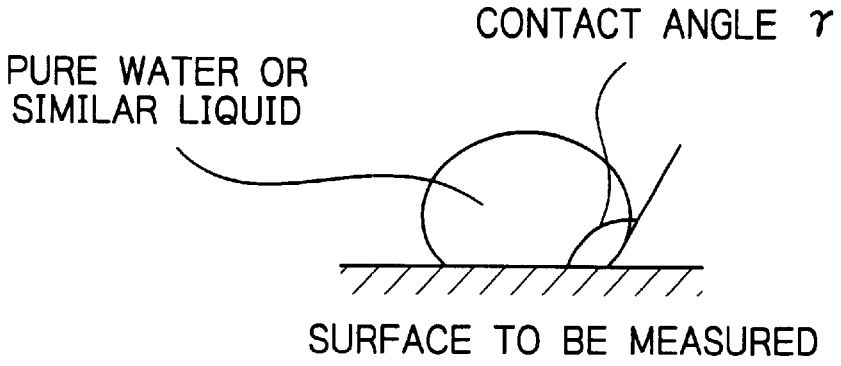
FIG. 39 is a view showing a relation between a reagent and a material to be measured.

The surface energy, or surface tension, W of a material to be measured may be expressed as follows:

$$W=\gamma(1+\cos\theta) \qquad \text{Eq.(1)}$$

where $\gamma$ denotes the surface tension of a reagent, and $\theta$ denotes the contact angle of the material to be measured with the reagent. FIG. 39 shows a relation between a reagent and a material to be measured. Surface tension is generally used as a substitute characteristic of surface energy.

A reagent is implemented by pure water or similar pure substance. Specifically, reagents having the same surface tension are used to measure the wettability of a material to be measured for thereby determining the variation of surface tension. Adhesion acting between two different substances increases with an increase in surface tension. While the Eq. (1) is used to determine surface tension (critical surface tension) with respect to a reagent (liquid), it is extensively used to determine how the adhesion of powder to the surface of a subject material varies.

Figure 40:
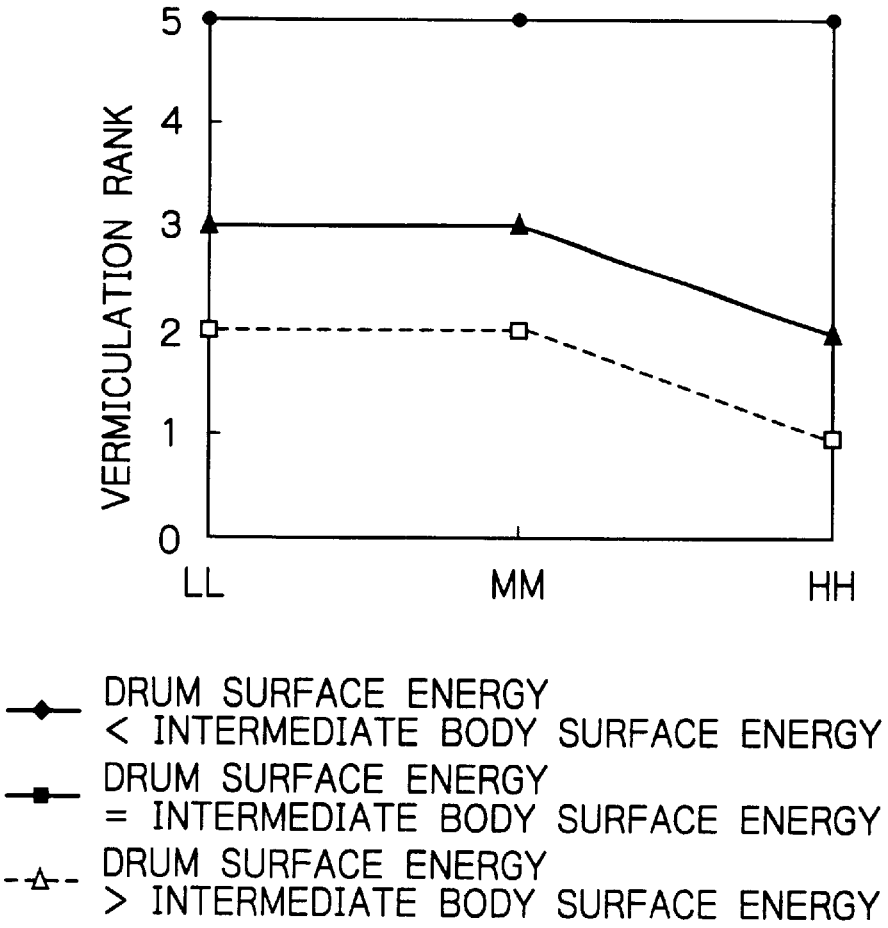
FIG. 40 is a graph showing vermiculation ranks determined in three different environments by varying the surface energy of the photoconductive element and that of an intermediate image transfer member.

FIG. 40 shows the results of experiments conducted by varying the surface energy of the drum 200 and that of the belt 261 in three different environments HH, MM and LL in order to determine differences between images formed on the belt 261. In the environment HH, temperature and humidity were 30° C. and 90%, respectively. Also, in the environment MM, temperature and humidity were 23° C. and 65%, respectively. Further, in the environment LL, temperature and humidity were 10° C. and 15%, respectively. It is to be noted that data shown in FIG. 40 indicate tendency in the initial stage of operation. In FIG. 40, the ordinate and abscissa indicate vermiculation ranks and the environments, respectively. As for vermiculation, rank 5 shows that vermiculation did not occur at all, while rank 1 shows that vermiculation was most conspicuous. Because ranks 4 and above could not be distinguished by eye, all images were picked up by a CCD (Charge Coupled Display) camera, binarized, and then estimated on an area ratio basis. For the estimation, use was made of solid, text image portions. A specific estimated image is shown in FIG. 41.

As FIG. 40 indicates, image transfer was stable without regard to the environment when the surface energy of the belt 261 was greater than the surface energy of the drum 200. When this condition was not satisfied, images of rank 4 or above were not achieved in any one of the environments HH, MM and LL. Particularly, in the environment HH, vermiculation was too conspicuous to render images with acceptable quality.

Figure 41:
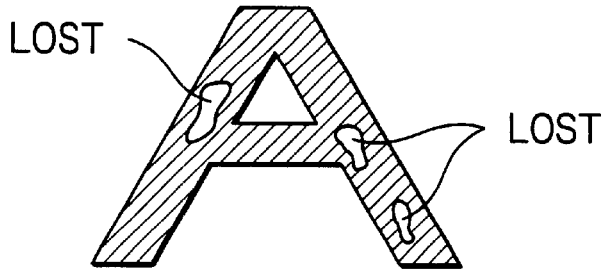
FIG. 41 is a view showing a specific vermicular image.
Figure 42:
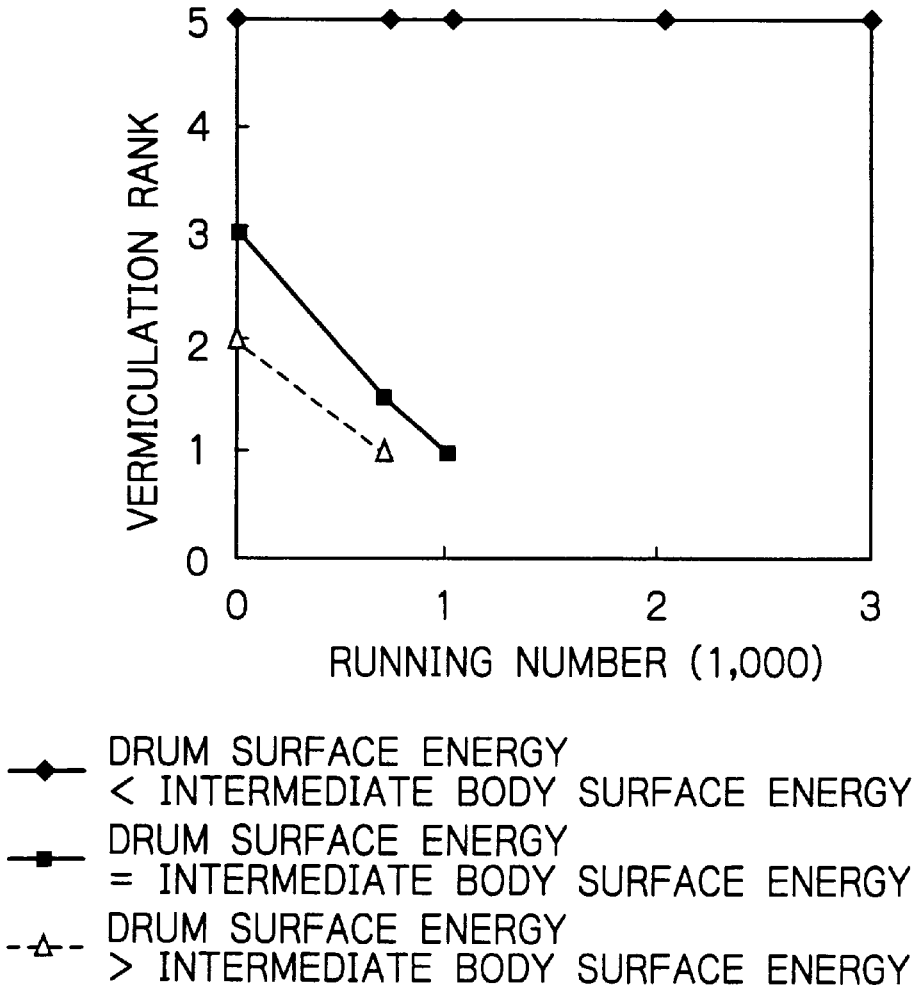
FIG. 42 is a graph showing a relation between the number of copies and vermiculation determined by varying the surface energy of the photoconductive element and that of the intermediate image transfer body.

FIG. 42 shows the result of a short running test (3,000 copies) conducted under the same surface energy conditions as shown in FIG. 41 except that only the environment MM was used. As shown, when the surface energy of the belt 261 was greater than the surface energy of the drum 200, the vermiculation rank did not fall. When this condition was not satisfied, toner filming occurred on the drum 200 when 500 copies or 1,000 copies were output, making it impossible to continue running. When the above condition was satisfied, running could be further extended to 20,000 copies without any trouble.

If desired, the drum 200 playing the role of an image carrier may be replaced with a photoconductive belt. Likewise, the belt 261 used as an intermediate image transfer body may be replaced with a drum.

As stated above, the illustrative embodiment has various unprecedented advantages, as enumerated below.

(1) When the drum or photoconductive element has a coefficient of friction of 0.02 or above, vermicular omission is obviated in an image portion where much toner is deposited. Also, in the case of development using a main magnet having a small half-width, the trailing edge of an image is prevented from being lost.

(2) The lubricant applied to the drum is also successful to obviate vermicular omission and the omission of the trailing edge of an image.

(3) The amount of the lubricant to be applied to the drum is variable to maintain the coefficient of friction of the drum surface constant without regard to aging or varying environment.

(4) In the case of development using a main magnet with a small half-width, the lubricant applied to the belt or intermediate image transfer body reduces wear of the drum and belt ascribable to friction acting therebetween. This insures images free from vermiculation without regard to aging or varying environment.

(5) The lubricant applied to the drum makes the surface energy of the belt greater than the surface energy of the drum. This improves toner transferability and thereby obviates local omission of an image at the time of image transfer. In addition, the lubricant is easy to mold and does not effect image quality at all, promoting easy control. This is also true with the lubricant applied to the belt.

(6) The ratio of the linear velocity of the sleeve to that of the drum can be increased even in a system in which the coefficient of friction of the drum surface is lowered. It follows that the developing ability and uniformity of dots can be improved without lowering the trailing edge omission level. Further, the omission of dots around characters is obviated, so that high quality images are achievable.

Various modifications will become possible for those skilled in the art after receiving the teachings of the present disclosure without departing from the scope thereof.

What is claimed is:

1. An image forming apparatus comprising:

a developing device including a main magnetic pole for causing a developer to magnetically deposit on an outer periphery of a developer carrier in a form of a magnet brush; and an image carrier facing said developing device;

wherein said image carrier has a coefficient of friction of 0.5 or below, and a flux density in a normal direction has an attenuation ratio of 40% or above, as measured in a developing region where the magnet brush contacts said image carrier.

2. The apparatus as claimed in claim 1, further comprising a lubricator for applying a lubricant to said image carrier to thereby provide said image carrier with the coefficient of friction of 0.5 or below.

3. The apparatus as claimed in claim 2, further comprising a cleaner for cleaning said image carrier in contact with said image carrier.

4. The apparatus as claimed in claim 3, wherein said cleaner comprises a blade.

5. The apparatus as claimed in claim 4, wherein the lubricant comprises inorganic fine particles chargeable to a same polarity as toner contained in the developer.

6. The apparatus as claimed in claim 5, wherein the lubricant comprises zinc stearate.

7. The apparatus as claimed in claim 6, wherein said lubricator comprises a brush roller rotatable in contact with said image carrier.

8. The apparatus as claimed in claim 7, wherein said brush roller comprises a loop brush.

9. The apparatus as claimed in claim 7, wherein said brush roller comprises a straight brush.

10. The apparatus as claimed in claim 7, further comprising a rotatable, lubricant feeding member for feeding the lubricant to said brush roller, and a difference in peripheral speed between said brush roller and said lubricant feeding member is greater than a difference in peripheral speed between said image carrier and said brush roller.

11. The apparatus as claimed in claim 7, wherein said brush roller rotates in an opposite direction to image carrier while said lubricant feeding member rotates in an opposite direction to or a same direction as said brush roller.

12. The apparatus as claimed in claim 7, wherein said brush roller rotates in a same direction as said image carrier while said lubricant feeding member rotates in an opposite direction to or a same direction as said brush roller.

13. The apparatus as claimed in claim 12, wherein said lubricator is positioned upstream of said cleaner, but downstream of an image transferring device, in a direction of rotation of said image carrier.

14. The apparatus as claimed in claim 12, wherein said lubricator is positioned upstream of a charger for uniformly charging said image carrier, but downstream of said cleaner, in a direction of rotation of said image carrier.

15. The apparatus as claimed in claim 12, wherein said lubricator is positioned upstream of said developing device, but downstream of a charger for uniformly charging said image carrier, in a direction of rotation of said image carrier.

16. The apparatus as claimed in claim 1, further comprising a cleaner for cleaning said image carrier in contact with said image carrier.

17. The apparatus as claimed in claim 2, wherein the lubricant comprises inorganic fine particles chargeable to a same polarity as toner contained in the developer.

18. The apparatus as claimed in claim 2, wherein the lubricant comprises a fluorine-contained lubricant chargeable to an opposite polarity to toner contained in the developer.

19. The apparatus as claimed in claim 2, wherein said lubricator comprises a brush roller rotatable in contact with said image carrier.

20. The apparatus as claimed in claim 3, wherein said lubricator is positioned upstream of said cleaner, but downstream of an image transferring device, in a direction of rotation of said image carrier.

21. The apparatus as claimed in claim 3, wherein said lubricator is positioned upstream of a charger for uniformly charging said image carrier, but downstream of said cleaner, in a direction of rotation of said image carrier.

22. The apparatus as claimed in claim 2, wherein said lubricator is positioned upstream of said developing device, but downstream of a charger for uniformly charging said image carrier, in a direction of rotation of said image carrier.

23. An image forming apparatus comprising:

a developing device including a main magnetic pole for causing a developer to magnetically deposit on an outer periphery of a developer carrier in a form of a magnet brush; and an image carrier facing said developing device;

wherein said image carrier has a coefficient of friction of 0.5 or below, and said main magnetic pole has a flux density in a normal direction that has an attenuation ratio of 40% or above.

24. The apparatus as claimed in claim 23, further comprising a lubricator for applying a lubricant to said image carrier to thereby provide said image carrier with the coefficient of friction of 0.5 or below.

25. The apparatus as claimed in claim 24, further comprising a cleaner for cleaning said image carrier in contact with said image carrier.

26. The apparatus as claimed in claim 25, wherein said cleaner comprises a blade.

27. The apparatus as claimed in claim 26, wherein the lubricant comprises inorganic fine particles chargeable to a same polarity as toner contained in the developer.

28. The apparatus as claimed in claim 27, wherein the lubricant comprises zinc stearate.

29. The apparatus as claimed in claim 28, wherein said lubricator comprises a brush roller rotatable in contact with said image carrier.

30. The apparatus as claimed in claim 29, wherein said brush roller comprises a loop brush.

31. The apparatus as claimed in claim 29, wherein said brush roller comprises a straight brush.

32. The apparatus as claimed in claim 29, further comprising a rotatable, lubricant feeding member for feeding the lubricant to said brush roller, and a difference in peripheral speed between said brush roller and said lubricant feeding member is greater than a difference in peripheral speed between said image carrier and said brush roller.

33. The apparatus as claimed in claim 29, wherein said brush roller rotates in an opposite direction to said image carrier while said lubricant feeding member rotates in an opposite direction to or a same direction as said brush roller.

34. The apparatus as claimed in claim 29, wherein said brush roller rotates in a same direction as said image carrier while said lubricant feeding member rotates in an opposite direction to or a same direction as said brush roller.

35. The apparatus as claimed in claim 34, wherein said lubricator is positioned upstream of said cleaner, but downstream of an image transferring device, in a direction of rotation of said image carrier.

36. The apparatus as claimed in claim 34, wherein said lubricator is positioned upstream of a charger for uniformly charging said image carrier, but downstream of said cleaner, in a direction of rotation of said image carrier.

37. The apparatus as claimed in claim 34, wherein said lubricator is positioned upstream of said developing device, but downstream of a charger for uniformly charging said image carrier, in a direction of rotation of said image carrier.

38. The apparatus as claimed in claim 23, further comprising a cleaner for cleaning said image carrier in contact with said image carrier.

39. The apparatus as claimed in claim 23, wherein the main magnetic pole has a half-value of 25°.

40. The apparatus as claimed in claim 24, wherein the lubricant comprises inorganic fine particles chargeable to a same polarity as toner contained in the developer.

41. The apparatus as claimed in claim 24, wherein the lubricant comprises a fluorine-contained lubricant chargeable to an opposite polarity to toner contained in the developer.

42. The apparatus as claimed in claim 24, wherein said lubricator comprises a brush roller rotatable in contact with said image carrier.

43. The apparatus as claimed in claim 25, wherein said lubricator is positioned upstream of said cleaner, but downstream of an image transferring device, in a direction of rotation of said image carrier.

44. The apparatus as claimed in claim 25, wherein said lubricator is positioned upstream of a charger for uniformly charging said image carrier, but downstream of said cleaner, in a direction of rotation of said image carrier.

45. The apparatus as claimed in claim 24, wherein said lubricator is positioned upstream of said developing device, but downstream of a charger for uniformly charging said image carrier, in a direction of rotation of said image carrier.

46. An image forming apparatus comprising:

a developing device including a main magnetic pole for causing a developer to magnetically deposit on an outer periphery of a developer carrier in a form of a magnet brush;

an image carrier facing said developing device; and a lubricator for applying a lubricant to said image carrier;

wherein said image carrier has a coefficient of friction of 0.5 or below, and a magnetic pole adjoining said main magnetic pole has a flux density in a normal direction that has an attenuation ratio of 40% or above.

47. The apparatus as claimed in claim 46, wherein said lubricator provides said image carrier with the coefficient of friction of 0.5 or below.

48. The apparatus as claimed in claim 47, further comprising a cleaner for cleaning said image carrier in contact with said image carrier.

49. The apparatus as claimed in claim 48, wherein said cleaner comprises a blade.

50. The apparatus as claimed in claim 49, wherein the lubricant comprises inorganic fine particles chargeable to a same polarity as toner contained in the developer.

51. The apparatus as claimed in claim 50, wherein the lubricant comprises zinc stearate.

52. The apparatus as claimed in claim 51, wherein said lubricator comprises a brush roller rotatable in contact with said image carrier.

53. The apparatus as claimed in claim 52, wherein said brush roller comprises a loop brush.

54. The apparatus as claimed in claim 52, wherein said brush roller comprises a straight brush.

55. The apparatus as claimed in claim 52, further comprising a rotatable, lubricant feeding member for feeding the lubricant to said brush roller, and a difference in peripheral speed between said brush roller and said lubricant feeding member is greater than a difference in peripheral speed between said image carrier and said brush roller.

56. The apparatus as claimed in claim 52, wherein said brush roller rotates in an opposite direction to said image carrier while said lubricant feeding member rotates in an opposite direction to or a same direction as said brush roller.

57. The apparatus as claimed in claim 52, wherein said brush roller rotates in a same direction as said image carrier while said lubricant feeding member rotates in an opposite direction to or a same direction as said brush roller.

58. The apparatus as claimed in claim 57, wherein said lubricator is positioned upstream of said cleaner, but downstream of an image transferring device, in a direction of rotation of said image carrier.

59. The apparatus as claimed in claim 57, wherein said lubricator is positioned upstream of a charger for uniformly charging said image carrier, but downstream of said cleaner, in a direction of rotation of said image carrier.

60. The apparatus as claimed in claim 57, wherein said lubricator is positioned upstream of said developing device, but downstream of a charger for uniformly charging said image carrier, in a direction of rotation of said image carrier.

61. The apparatus as claimed in claim 46, further comprising a cleaner for cleaning said image carrier in contact with said image carrier.

62. The apparatus as claimed in claim 46, wherein the main magnetic pole has a half-value of 25°.

63. The apparatus as claimed in claim 46, wherein the lubricant comprises inorganic fine particles chargeable to a same polarity as toner contained in the developer.

64. The apparatus as claimed in claim 46, wherein the lubricant comprises a fluorine-contained lubricant chargeable to an opposite polarity to toner contained in the developer.

65. The apparatus as claimed in claim 46, wherein said lubricator comprises a brush roller rotatable in contact with said image carrier.

66. The apparatus as claimed in claim 46, wherein said lubricator is positioned upstream of said cleaner, but downstream of an image transferring device, in a direction of rotation of said image carrier.

67. The apparatus as claimed in claim 46, wherein said lubricator is positioned upstream of a charger for uniformly charging said image carrier, but downstream of said cleaner, in a direction of rotation of said image carrier.

68. The apparatus as claimed in claim 46, wherein said lubricator is positioned upstream of said developing device, but downstream of a charger for uniformly charging said image carrier, in a direction of rotation of said image carrier.

* * * * *